US011547159B2

(12) United States Patent
Powell

(10) Patent No.: US 11,547,159 B2
(45) Date of Patent: Jan. 10, 2023

(54) FACE SHIELD ASSEMBLY AND METHOD

(71) Applicant: Steven Powell, New York, NY (US)

(72) Inventor: Steven Powell, New York, NY (US)

( * ) Notice: Subject to any disclaimer, the term of this patent is extended or adjusted under 35 U.S.C. 154(b) by 0 days.

(21) Appl. No.: 17/574,600

(22) Filed: Jan. 13, 2022

(65) Prior Publication Data

US 2022/0132952 A1 May 5, 2022

Related U.S. Application Data

(63) Continuation of application No. 17/061,107, filed on Oct. 1, 2020, now Pat. No. 11,259,579.

(60) Provisional application No. 63/051,332, filed on Jul. 13, 2020.

(51) Int. Cl.

| | |
|---|---|
| ***A42B 1/22*** | (2006.01) |
| ***A42B 7/00*** | (2006.01) |
| ***A41D 13/11*** | (2006.01) |

(52) U.S. Cl.

CPC ..... *A41D 13/1161* (2013.01); *A42B 1/22* (2013.01); *A42B 7/00* (2013.01)

(58) Field of Classification Search

CPC ..... A41D 13/1107; A41D 13/1115; A41D 13/1123; A41D 13/1163; A42B 1/18; A42B 1/22; A42B 1/24; A42B 7/00

See application file for complete search history.

(56) References Cited

U.S. PATENT DOCUMENTS

| | | | | |
|---|---|---|---|---|
| 4,821,341 | A | 4/1989 | Baptiste | |
| 5,424,787 | A | 6/1995 | Zegarelli | |
| 6,023,788 | A * | 2/2000 | McCallum | A42B 1/241 2/209.13 |
| 6,131,201 | A | 10/2000 | Chu | |
| 6,467,096 | B1 | 10/2002 | Coluccio | |
| 7,240,372 | B2 | 7/2007 | Larson | |
| 7,255,436 | B2 * | 8/2007 | Tracy | G02C 3/02 2/209.13 |
| 8,402,564 | B2 | 3/2013 | Duwyn-Zylstra | |
| 8,479,319 | B1 | 7/2013 | Erhardt | |
| 8,555,418 | B2 | 10/2013 | Singh et al. | |
| 8,621,668 | B1 | 1/2014 | Nolz | |
| 9,032,548 | B2 | 5/2015 | Isobe | |
| 9,072,331 | B2 * | 7/2015 | McNeal | A42B 3/185 |
| 2008/0250538 | A1 | 10/2008 | Saladino | |
| 2010/0275343 | A1 | 11/2010 | Gibson et al. | |
| 2011/0072564 | A1 | 3/2011 | Krauter | |

(Continued)

FOREIGN PATENT DOCUMENTS

| | | |
|---|---|---|
| CN | 204409706 U | 6/2015 |
| CN | 205512536 U | 8/2016 |

(Continued)

*Primary Examiner* — Katherine M Moran

(74) *Attorney, Agent, or Firm* — BakerHostetler

(57) ABSTRACT

A face shield and head covering combination is provided. The head covering comprises a body and an attachment element. The body defines a head opening configured to receive a user's head therethrough. The attachment element is coupled to the body and configured to couple to a face shield positionable on the user's face. The attachment element is configured to transition between a first position on the body and a second position on the body, wherein the second position is spaced from the first position.

10 Claims, 28 Drawing Sheets

(56) References Cited

U.S. PATENT DOCUMENTS

| | | | | |
|---|---|---|---|---|
| 2015/0135406 | A1* | 5/2015 | Nguyen | A42B 1/205 2/209.12 |
| 2017/0055597 | A1 | 3/2017 | Lekven | |
| 2019/0365009 | A1* | 12/2019 | Frieder, III | A42B 3/185 |
| 2020/0085127 | A1 | 3/2020 | Garmon | |
| 2020/0093212 | A1 | 3/2020 | Zheng | |
| 2020/0390177 | A1* | 12/2020 | Garmon | A42B 1/04 |
| 2021/0321726 | A1* | 10/2021 | Jourgensen | A41D 13/129 |
| 2021/0345702 | A1* | 11/2021 | Volk | A41D 27/08 |

FOREIGN PATENT DOCUMENTS

| | | | |
|---|---|---|---|
| CN | 106820377 | A | 6/2017 |
| CN | 107467767 | A | 12/2017 |
| CN | 111184305 | A | 5/2020 |
| FR | 3083967 | A1 | 1/2020 |
| JP | 3134527 | U | 8/2007 |
| JP | 3142543 | U | 6/2008 |
| KR | 100812800 | B1 | 3/2008 |

* cited by examiner

FACE SHIELD ASSEMBLY AND METHOD

CROSS-REFERENCE TO RELATED APPLICATIONS

This application claims the benefit of U.S. Provisional Application No. 63/051,332, filed Jul. 13, 2020, now U.S. Pat. No. 11,259,579, the disclosure of which is incorporated by reference herein in its entirety.

TECHNICAL FIELD

The present invention relates to face masks and face coverings, and more particularly, to a face mask or face covering secured to a head covering.

BACKGROUND

Due to recent events regarding COVID-19, wearing a face protection system has become commonplace for routine activities, such as grocery shopping, going to work, attending an event, etc. In some circumstances and locations, wearing a face mask can be required.

Conventional face protection systems can include face masks that are attached to a person's head, ears, and/or neck, and wrap around the user's face from the bridge of their nose to under their chin. The face mask needs to be secure enough to stay in place while still allowing the user to talk. Many face masks are either too loose or too tight, which can tempt the user to touch the mask and/or pull it out of place putting the user at risk from unnecessarily touching their face and limiting the effectiveness of the mask.

The foregoing background discussion is intended solely to aid the reader. It is not intended to limit the innovations described herein. Thus, the foregoing discussion should not be taken to indicate that any particular element of a prior system is unsuitable for use with the innovations described herein, nor is it intended to indicate that any element is essential in implementing the innovations described herein.

SUMMARY

The foregoing needs are met, to a great extent, by the face protection system and method disclosed in the present application.

The face protection system includes a head covering and a face shield coupled to the head covering. Connecting the face shield to the head covering can relieve pressure that is typically applied to the ears, the back of the head, and/or the neck of the user when using a conventional face shield. The face protection system can also provide better coverage for the face.

The face protection system further includes an adjustable attachment element configured to adjust the fit of the face shield to a user's face. The adjustability factor enhances the medical benefits of the mask by, for example, decreasing inflow of unfiltered air due to better fit, greater facial surface adhesion of mask that decreases opportunity for airborne contamination, and greater comfort—thereby enhancing longer user wear time.

An aspect of the present disclosure provides a head covering. The head covering comprises a body and an attachment element. The body defines a head opening configured to receive a user's head therethrough. The attachment element is coupled to the body, and is configured to couple to a face shield positionable on the user's face. The attachment element is configured to transition between a first position on the body and a second position on the body, wherein the second position is spaced from the first position.

Another aspect of the present disclosure provides a face protection system for adjusting a face shield positionable on a user's face. The face protection system comprises a head covering that includes a body and an attachment element. The body defines a head opening configured to receive the user's head therethrough. The attachment element is coupled to the body, and is configured to couple to the face shield via a strap. The attachment element is further configured to transition between a first position and a second position spaced from the first position, whereby when the attachment element transitions from the first position to the second position a tension in the strap transitions from a first tension to a second tension that is greater than the first tension.

This summary is provided to introduce a selection of concepts in a simplified form that are further described below in the Detailed Description section. This Summary is not intended to identify key features or essential features of the claimed subject matter, nor is it intended to be used to limit the scope of the claimed subject matter. Furthermore, the claimed subject matter is not constrained to limitations that solve any or all disadvantages noted in any part of this disclosure.

BRIEF DESCRIPTION OF THE DRAWINGS

The foregoing summary, as well as the following detailed description of illustrative embodiments of the intervertebral implant of the present application, will be better understood when read in conjunction with the appended drawings. For the purposes of illustrating the expandable intervertebral implant of the present application, there is shown in the drawings illustrative embodiments. It should be understood, however, that the application is not limited to the precise arrangements and instrumentalities shown. In the drawings.

DETAILED DESCRIPTION OF ILLUSTRATIVE EMBODIMENTS

Figure 1:
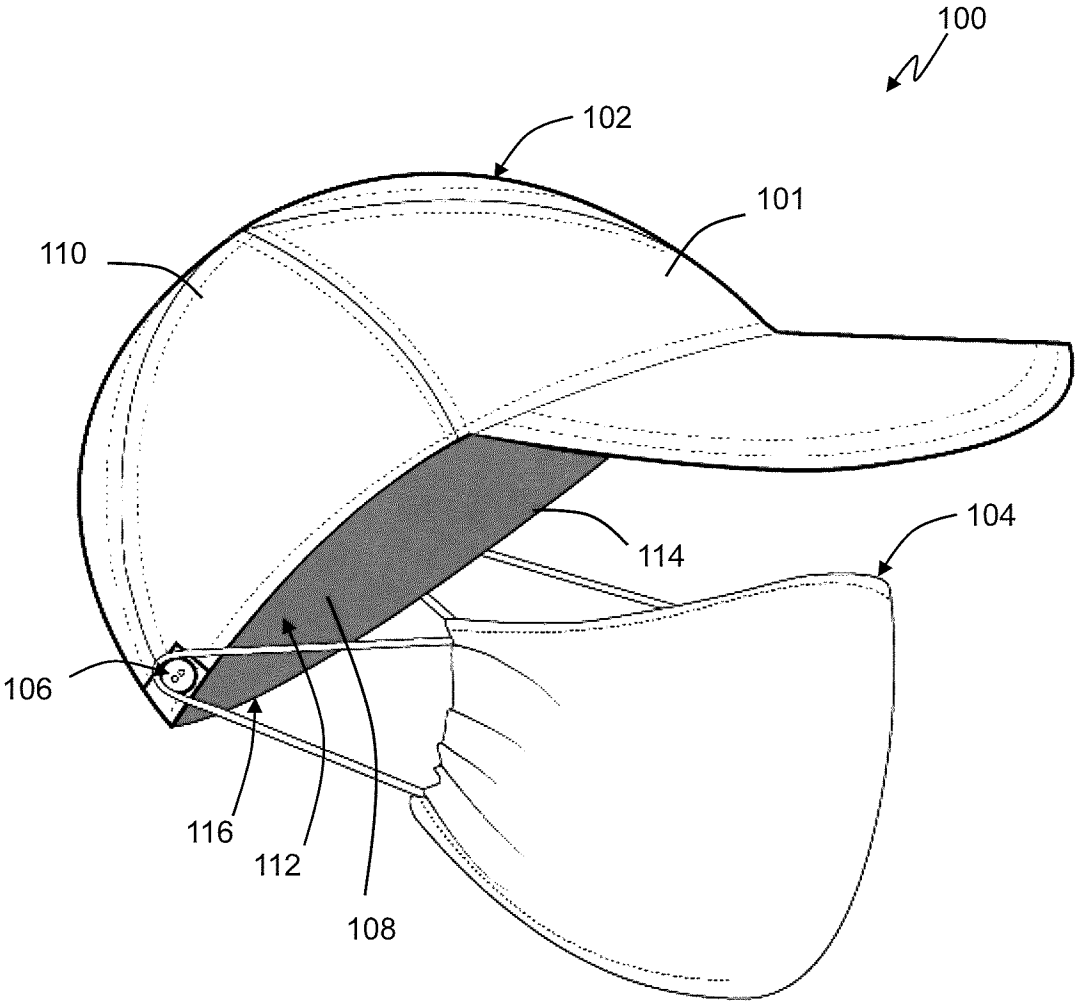
FIG. 1 illustrates a side view of a face protection system, according to an aspect of this disclosure.

The present disclosure can be understood more readily by reference to the following detailed description taken in connection with the accompanying figures and examples, which form a part of this disclosure. It is to be understood that this disclosure is not limited to the specific devices, methods, applications, conditions or parameters described and/or shown herein, and that the terminology used herein is for the purpose of describing particular embodiments by way of example only and is not intended to be limiting of the scope of the present disclosure. Also, as used in the specification including the appended claims, the singular forms "a," "an," and "the" include the plural, and reference to a particular numerical value includes at least that particular value, unless the context clearly dictates otherwise.

Certain terminology used in this description is for convenience only and is not limiting. The words "top", "bottom", "inner", "outer", "above", "below", "axial", "transverse", "circumferential," and "radial" designate directions in the drawings to which reference is made. The term "plurality", as used herein, means more than one. When a range of values is expressed, another embodiment includes from the one particular value and/or to the other particular value. Similarly, when values are expressed as approximations, by use of the antecedent "about," it will be understood that the particular value forms another embodiment. The term "substantially" is intended to mean considerable in extent or largely but not necessarily wholly that which is specified. All ranges are inclusive and combinable. The terminology includes the above-listed words, derivatives thereof and words of similar import.

Figure 4A:
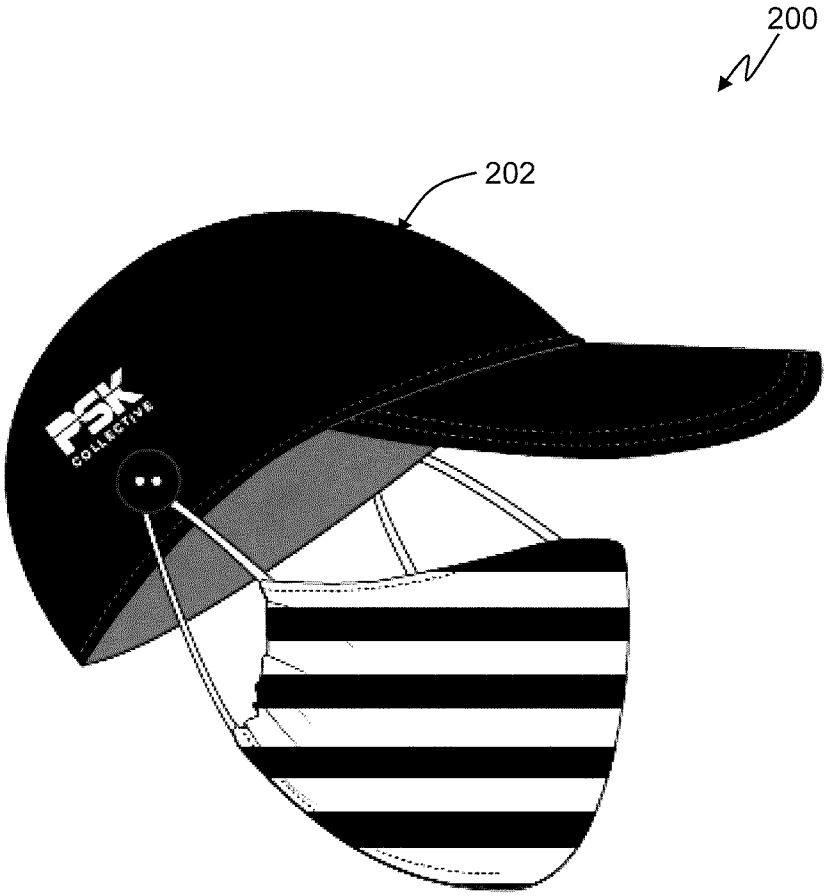
FIG. 4A illustrates a side view of a face protection system including a baseball cap, according to an aspect of this disclosure.
Figure 8:
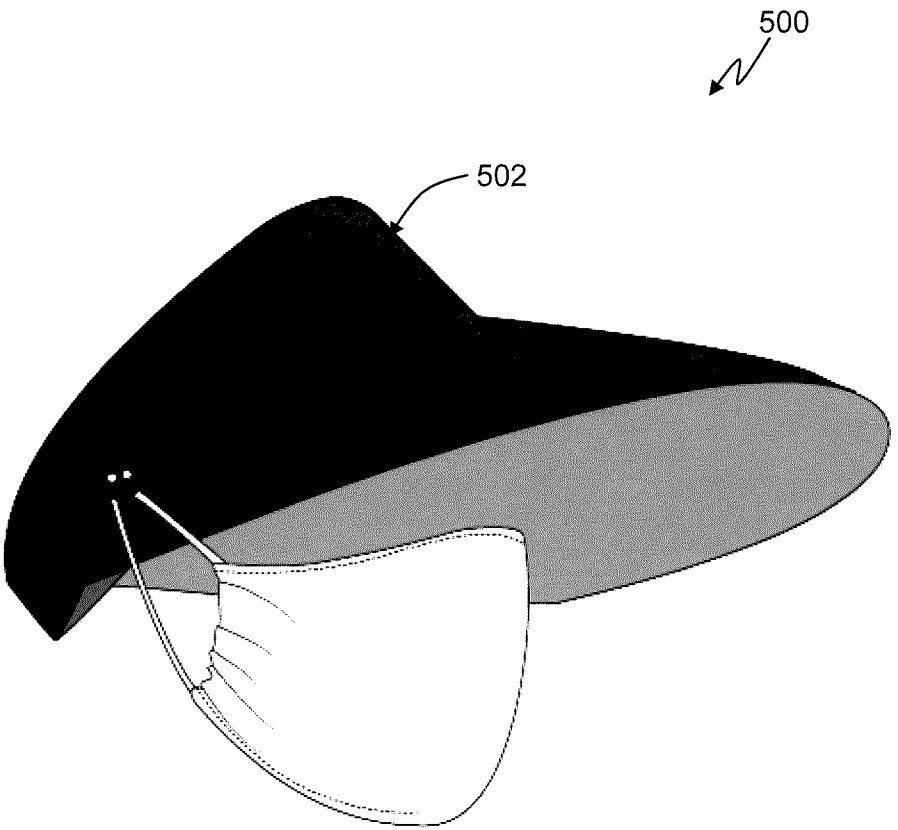
FIG. 8 illustrates a side view of a face protection system including a visor hat, according to an aspect of this disclosure.
Figure 9:
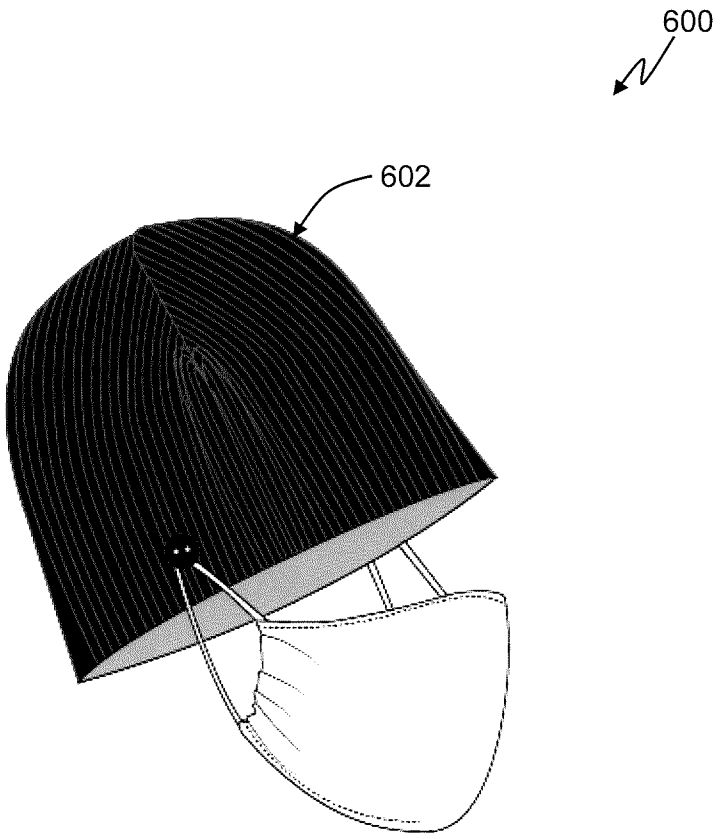
FIG. 9 illustrates a side view of a face protection system including a skull cap, according to an aspect of this disclosure.

FIG. 1 illustrates a side perspective view of a face protection system 100, according to an aspect of this disclosure. The face protection system 100 includes a head covering 102 and a face shield 104. The head covering 102 can comprise a baseball cap 202 (see FIG. 4), a bucket hat 302 (see FIG. 5), a medical cap 402, (see FIG. 6), a visor hat 502 (see FIG. 8), a skull cap 602 (see FIG. 9), or other head covering configured to be positioned on a user's head. The face shield 104 is positionable on the user's face to cover their nose and mouth. The face shield 104 is coupled to the head covering 102 and is adjustable to fit to the particular facial anatomy of the user, as further described herein. The face shield 104 can include a face mask, neck gaiter, goggles or other face shield configured to cover a user's mouth, nose, and/or eyes.

The face shield 104 can also comprise medical goggles. Medical goggles in hazardous situations can require a substantially airtight fit. The importance of adhesion of the goggles to a doctor's face during surgery is that it can prevent mishaps, such as splatter getting into doctor's eyes, Covid-19, or still other mishaps. The goggles seal is created primarily by a strength of elastic or rubber bands securing the goggles to the user. But for doctors and nurses in the Covid-19 environment, or other potentially hazardous situations, an adjustable cap-mask that accommodates goggles can redistribute tight goggle pressure away from the back of the head, spreading it more evenly instead across the surface and structure of the cap or medical hat. The goggle's fit can be adjusted comfortably and easily via one of the adjusters described below.

The head covering 102 comprises a body 101 and an attachment element 106. The body 101 includes an inner surface 108 and an opposing outer surface 110. The inner surface 108 defines a head cavity 112 configured to receive a user's head within. The inner surface 108 includes a peripheral edge 114 that extends about a periphery of the body 101. The peripheral edge 114 defines a head opening 116 that is configured to receive the user's head therethrough and into the head cavity 112.

Figure 2A:
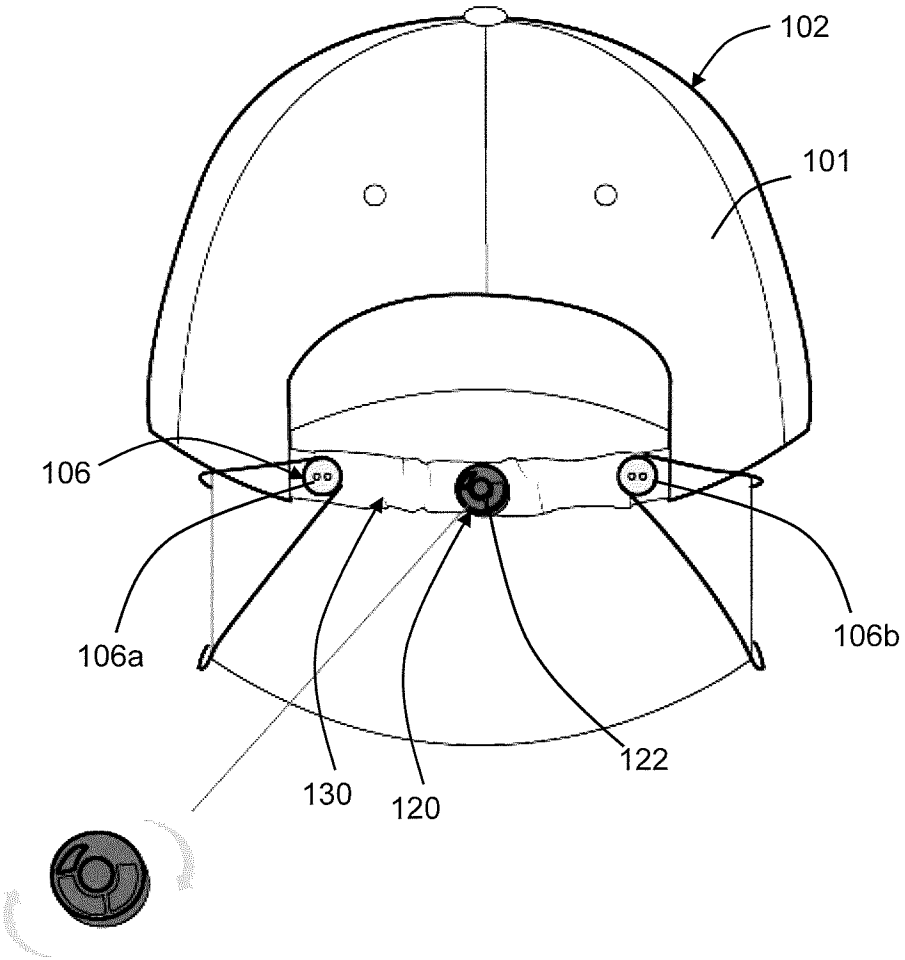
FIG. 2A illustrates a back view of the face protection system shown in FIG. 1, according to an aspect of this disclosure.

With reference to FIG. 2A, the attachment element 106 is coupled to the body 101 of the head covering 102. The attachment element 106 is configured to couple to the face shield 104. For example, when the head covering 102 is positioned on the head of the user, the face shield 104 can be coupled to the attachment element 106 to secure the face shield 104 to the user's face. The attachment element 106 can include a first attachment element 106*a* and a second attachment element 106*b*. The first and second attachment elements 106*a* and 106*b* can be spaced from each other about the body 101. In an aspect, the first and second attachment elements 106*a* and 106*b* can be positioned on the outer surface 110 of the body 101. Alternatively, the first and second attachment elements 106*a* and 106*b* can be positioned on the inner surface 108 of the body 101.

The first and second attachment elements 106*a* and 106*b* can be transitioned between respective first positions and second positions on the body 101. The second position of each of the first and second attachment elements 106*a* and 106*b* is spaced apart from the respective first position of the first and second attachment elements 106*a* and 106*b*. For example, in the first position of the first attachment element 106*a*, the first attachment element 106*a* is positioned at a first location on the body 101, and in the second position of the first attachment element 106*a*, the first attachment element 106*a* is positioned at a second location on the body 101. The first and second locations on the body can be spaced apart from each other. The first and second positions of the second attachment element 106*b* can be similarly defined. It will be appreciated that the first and second attachment elements 106*a* and 106*b* can be transitioned between more than two positions. Transitioning the first and second attachment elements 106*a* and 106*b* between positions allows the user to secure the face shield 104 to their face by loosening and tightening the face shield 104.

The head covering 102 can further include a mask adjuster 120 (e.g. a first adjuster) coupled to the body 101. The adjuster 120 is further coupled to the first and second attachment elements 106*a* and 106*b*, and is configured to adjust a position of the first and second attachment elements 106*a* and 106*b*. For example, the adjuster 120 can be coupled to the first attachment element 106*a*, and can transition the first attachment element 106*a* between its first position to its second position. Additionally or alternatively, the adjuster 120 can be coupled to the second attachment element 106*b*, and can transition the second attachment element 106*b* between its first position and second position. In an aspect, the adjuster 120 can be configured to simultaneously transition the first and second attachment elements 106*a* and 106*b* between their respective first and second positions. The first attachment element 106*a* can be separated from the adjuster by a first distance when the first attachment element 106*a* is in the first position. The first attachment element 106*a* can be separated from the adjuster by a second distance when the first attachment element 106*a* is in the second position. The first distance can be greater than the second distance. The second attachment element 106*b* can be separated from the adjuster by a third distance when the second attachment element 106*b* is in the first position. The second attachment element 106*b* can be separated from the adjuster by a fourth distance when the second attachment element 106*b* is in the second position. The third distance can be greater than the fourth distance.

Figure 2B:
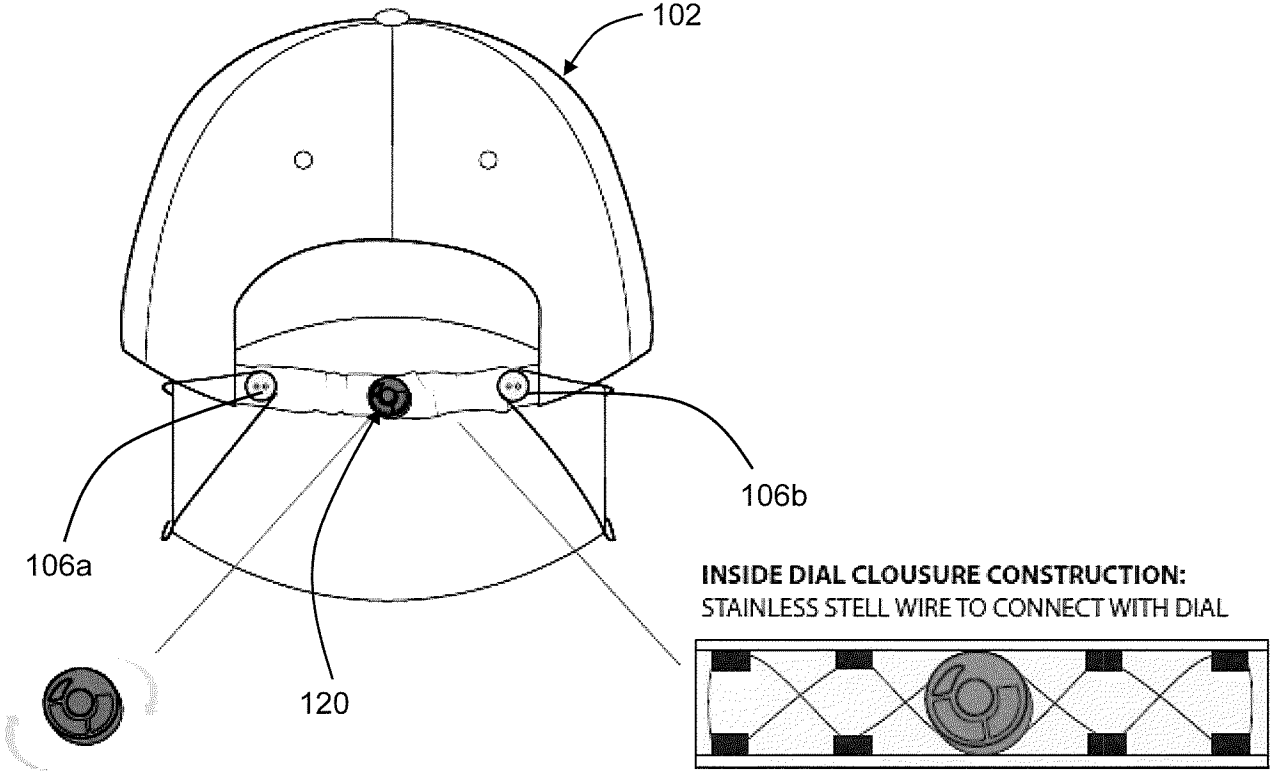
FIG. 2B illustrates a back view of an alternative aspect of a face protection system, according to an aspect of this disclosure.

In an aspect, the adjuster 120 comprises a dial member 122 (see FIGS. 2A and 2B). The dial member 122 is rotatable between a first dial position and a second dial position rotatably spaced from the first dial position. Rotation of the dial member 122 can transition the first and second attachment elements 106*a* and 106*b* between their respective first and second positions. For example, when the dial member 122 is in the first dial position the first attachment element 106*a* is in the first position, and wherein when the dial member 122 is rotated to the second dial position the first attachment element 106*a* transitions to the second position. The dial member 122 can be configured to control the second attachment element 106*b* in a similar manner.

The dial member 122 can connect to each of the first and second attachment members 106*a* and 106*b* via a wire. In an aspect, a single wire extends between the first and second attachment members 106*a* and 106*b* and is connected to the dial member 122 positioned between the first and second attachment members 106*a* and 106*b*. Rotation of the dial member 122 can cause the wire to contract and loosen, thereby transitioning the first and second attachment members 106*a* and 106*b* between their respective first and second positions.

In an aspect, the head covering 102 can include more than one mask adjuster 120. For example, one mask adjuster can be coupled to the first attachment element 106*a*, and another mask adjuster can be coupled to the second attachment element 106*b*. Each attachment element 106*a* and 106*b* can be individually adjusted by each respective mask adjuster when fitting the face shield 104 on the user.

Figure 2C:
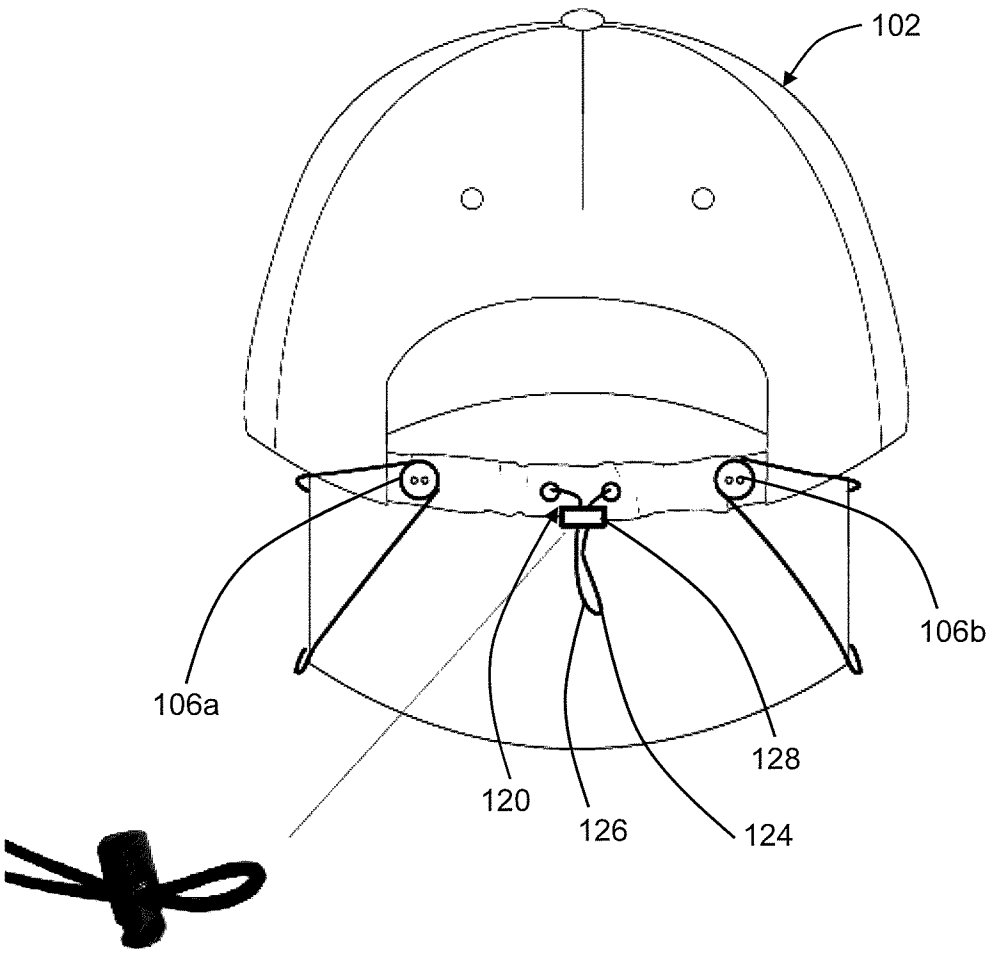
FIG. 2C illustrates a back view of an alternative aspect of a face protection system, according to an aspect of this disclosure.

In an alternative aspect, the adjuster 120 comprises a cord tightener 124 (see FIG. 2C). The cord tightener 124 includes a cord 126 and a lock member 128. The cord tightener 124 is transitionable between a first cord position and a second cord position by applying a tension to the cord 126. The cord tightener 124 can transition the first and second attachment elements 106*a* and 106*b* between their respective first and second positions. For example, when the cord tightener 124 is in the first cord position the first attachment element 106*a* is in its first position, and when tension is applied to the cord 126 to transition the cord tightener 124 to the second cord position, the first attachment element 106*a* transitions to its second position. When the first attachment element 106*a* transitions from the first position to the second position a tension in the strap transitions from a first tension to a second tension that is greater than the first tension. The cord tightener 124 can be configured to control the second attachment element 106*b* in a similar manner. The lock member 128 can transition between a locked position and an unlocked position. In the locked position, the lock member 128 can substantially prevent the cord tightener 124 from transitioning between the first and second cord positions. In the unlocked position, the cord tightener 124 can transition between the first and second cord positions.

Figure 2D:
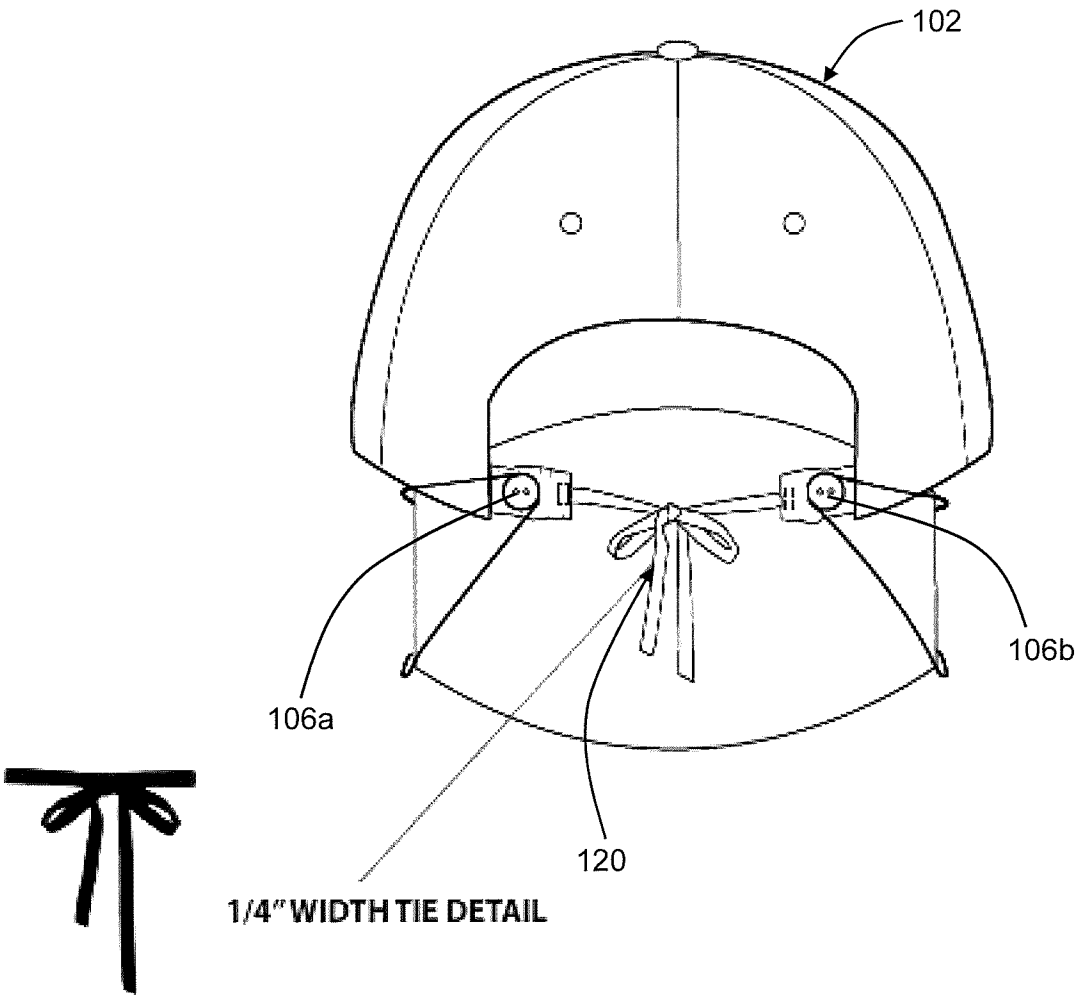
FIG. 2D illustrates a back view of an alternative aspect of a face protection system, according to an aspect of this disclosure.

In another alternative, the adjuster 120 comprises adjustable strings 129 (see FIG. 2D).

The body 101 can include a hat adjuster 130 (e.g. a second adjuster). The hat adjuster 130 is configured to transition the head opening 116 between a first size and a second size that is greater than the first size. In an aspect, the first and/or second attachment elements 106*a* and 106*b* can be coupled to the hat adjuster 130. For example, the first and second attachment elements 106*a* and 106*b* can be movable coupled to the hat adjuster 130 such that each of the first and second attachment elements 106*a* and 106*b* can move and/or translate relative to the had adjuster 130. In an aspect, the hat adjuster 130 can include a first slot and a second slot configured to receive the first attachment element 106*a* and the second attachment element 106*b*, respectively. Each of the first and second attachment elements 106*a* and 106*b* can move between their respective first and second positions by sliding within their respective first and second slots.

In an aspect, the first and second attachment elements 106*a* and 106*b* can be adjusted without also adjusting the size of the head opening 116. For example, when the head opening 116 is the first size, the first and second attachment elements 106*a* and 106*b* can be transitioned between their respective first and second positions while the head opening 116 remains in the first size. Allowing separate control for the face shield 104 and the head opening 116 allows the user to adjust the face shield 104 while not affecting the hat size.

Figure 3:
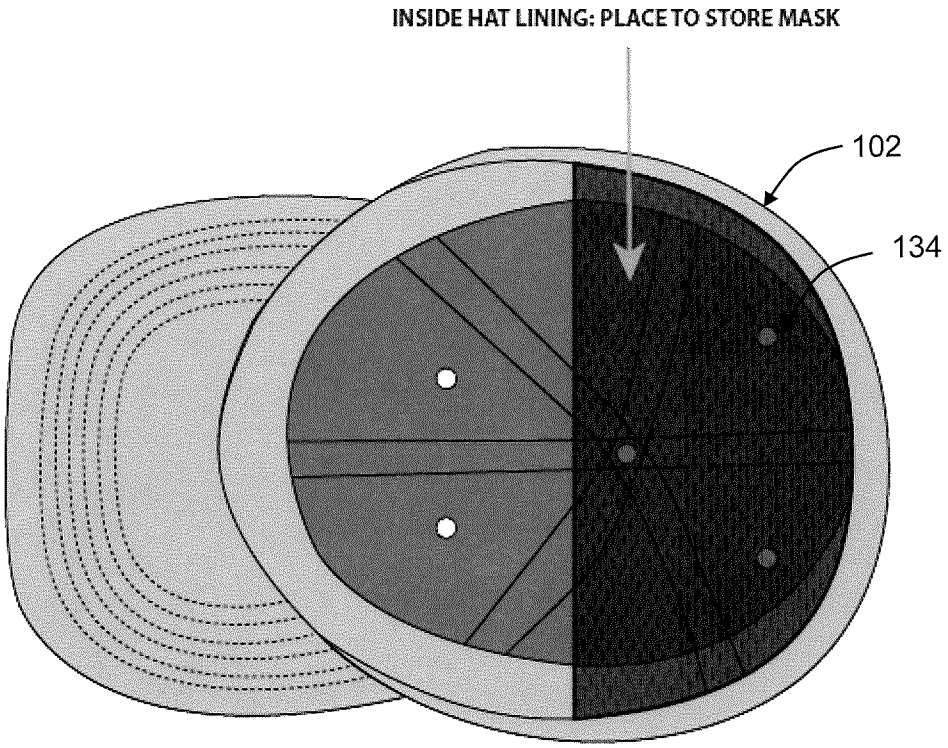
FIG. 3 illustrates a top view of a face protection system, according to an aspect of this disclosure.

Referring to FIG. 3, the body 101 of the head covering 102 can further comprise a mask compartment 134. The mask compartment and the body 101 can define a compartment opening (not labeled) and a compartment cavity (not labeled). The compartment opening is sized to receive the face shield 104 therethrough, and the compartment cavity is sized to store the face shield 104 within. The mask compartment 134 can be positioned within the head cavity 112 such that the compartment cavity is defined by the inner surface 108 of the body 101 and a surface of the mask compartment 134. In an alternative aspect, the mask compartment 134 can be located externally from the head cavity 112. For example, the compartment cavity can be defined by the outer surface 110 of the body 101 and the surface of the mask compartment 134.

Figure 4B:
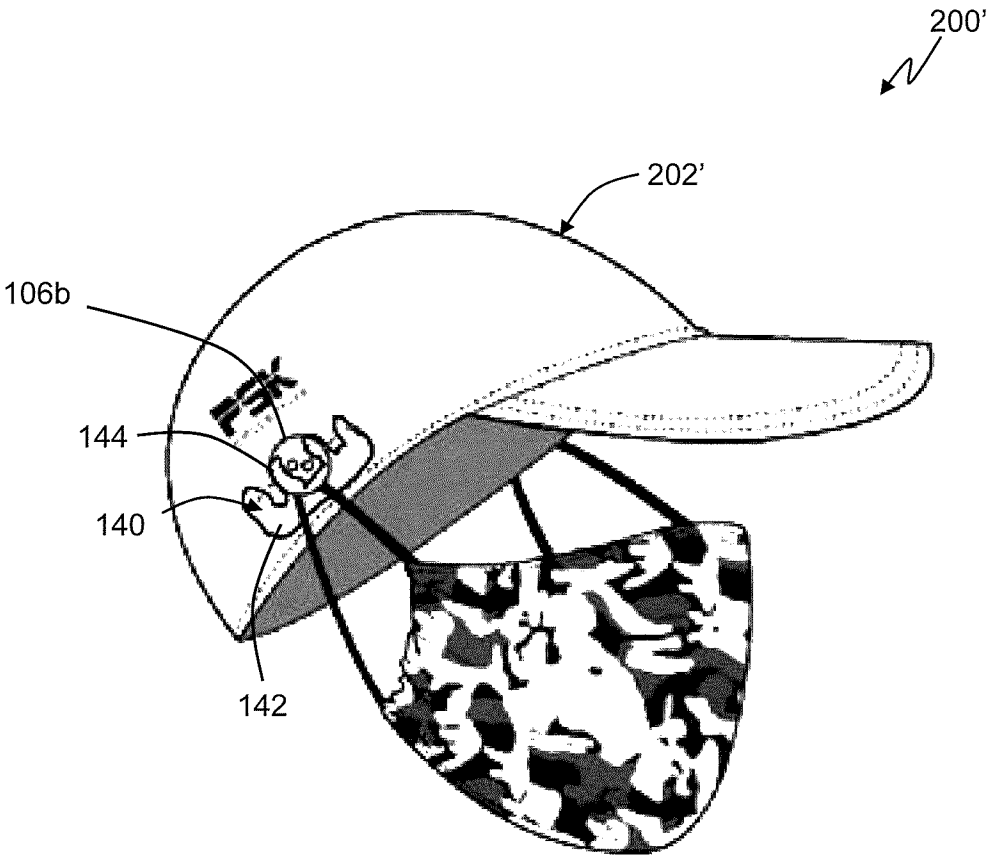
FIG. 4B illustrates a side view of an alternative aspect of a face protection system including a baseball cap, according to an aspect of this disclosure.
Figure 4C:
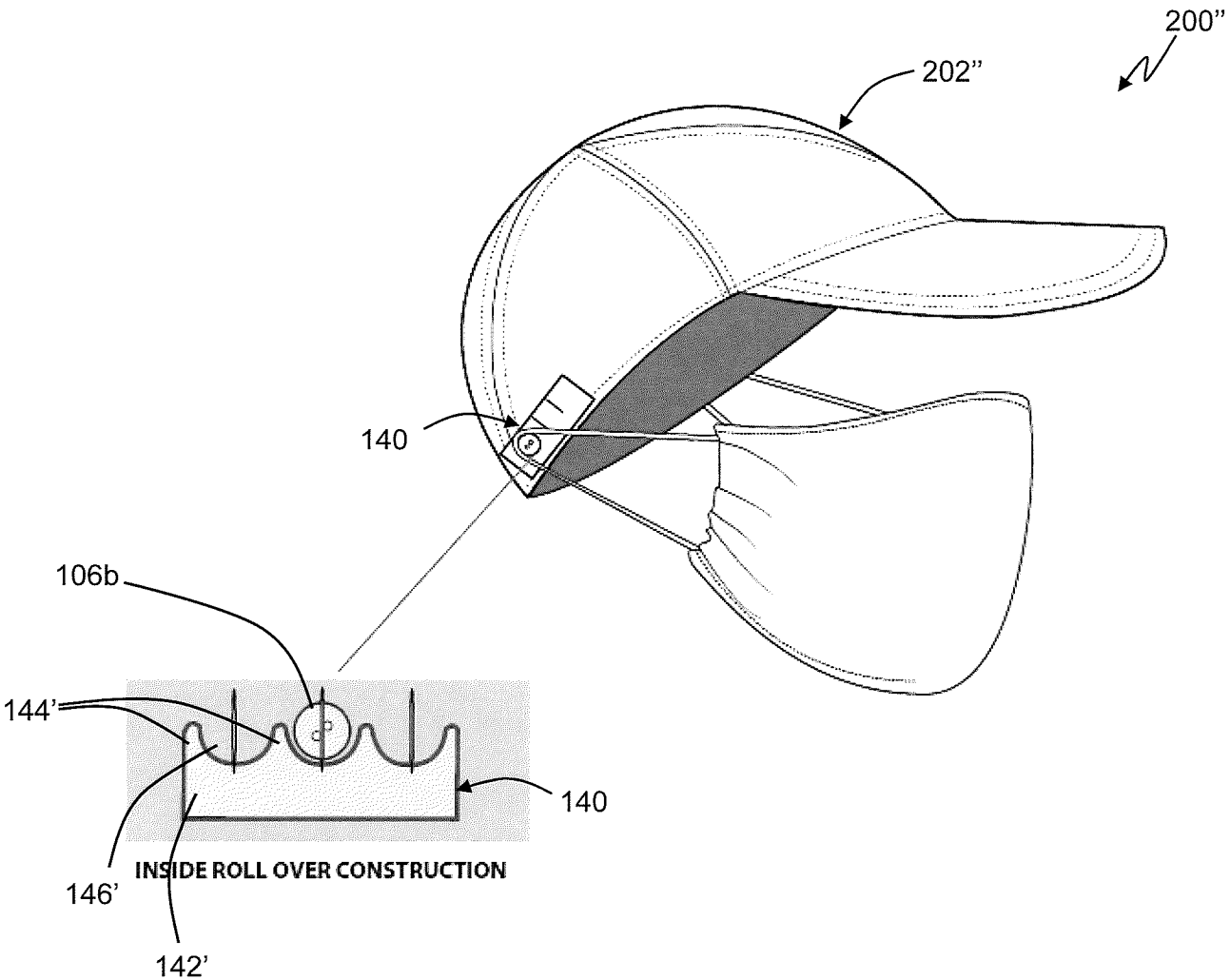
FIG. 4C illustrates a side view of an alternative aspect of a face protection system including a baseball cap, according to an aspect of this disclosure.

The head covering 102 can further include a slide member 140 (see FIGS. 4B and 4C). The slide member 140 can be coupled to the outer surface 110 of the body 101. Alternatively, the slide member 140 can be coupled to the inner surface 108 of the body 101. The attachment element 106 can be translatably coupled to the slide member 140 such that the attachment element 106 can translate between the first position and the second position when the attachment element 106 remains coupled to the slide member 140. For example, when the attachment element 106 is in the first position the attachment element 106 is positioned at a first slide position relative to the slide member 140. When the attachment element 106 transitions to the second position, the attachment element 106 is positioned at a second slide position relative to the slide member 140. The second slide position is spaced away from the first slide position. It will be appreciated that the head covering 102 can include more than one slide member 140. For example, the head covering 102 can include two slide members 140, one translatably coupled to the first attachment element 106*a*, and another translatably coupled to the second attachment element 106*b*.

In an aspect, the slide member 140 can include a rail 142 and at least one retention arm 144 extending from the rail 142. In an aspect, the retention arm 144 extends at least partially in an upward direction from the rail 142. The upward direction extending from the head opening 116 toward the head cavity 112. Each at least one retention arm 144 is configured to retain the attachment element 106 in a desired position. For example, when the attachment element 106 is in the first position, a first at least one retention arm 144 can substantially retain the attachment element 106 in the first position or otherwise substantially prevent the attachment element 106 from transitioning to the second position. Similarly, when the attachment element 106 is in the second position, a second at least one retention arm 144 can substantially retain the attachment element 106 in the second position or otherwise substantially prevent the attachment element 106 from transitioning to the first position.

FIG. 4B illustrates a "saw-tooth" configuration of the slide member 140 on a face protection system 200' including a head covering 202'. FIG. 4C illustrates an inside rollover configuration of the slide member 140 on a face protection system 200" including a head covering 202". The inside roller configuration include a rail 142' and at least one arm 144'. At least one recess 146' is formed between each at least one arm 144'. Each recess 146' can receive and retain the attachment element 106 within. In an aspect, the slide member 140 can be positioned within the head cavity 112 and coupled to the inner surface 108 of the body 101.

Figure 5A:
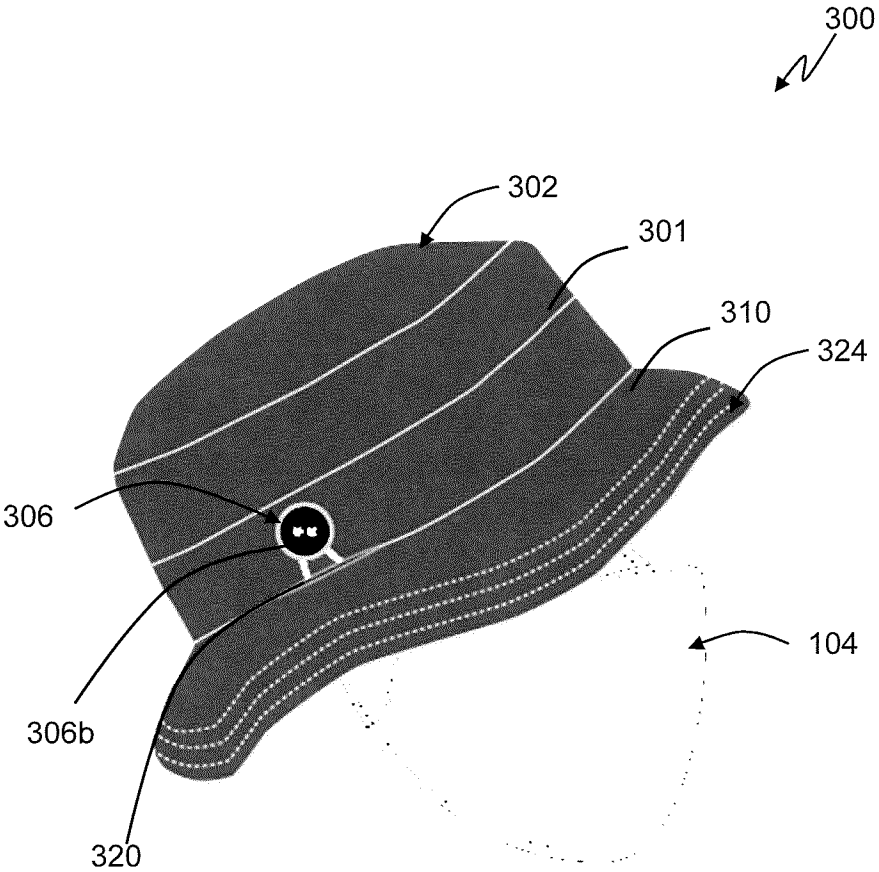
FIG. 5A illustrates a side view of a face protection system including a bucket hat, according to an aspect of this disclosure.
Figure 5B:
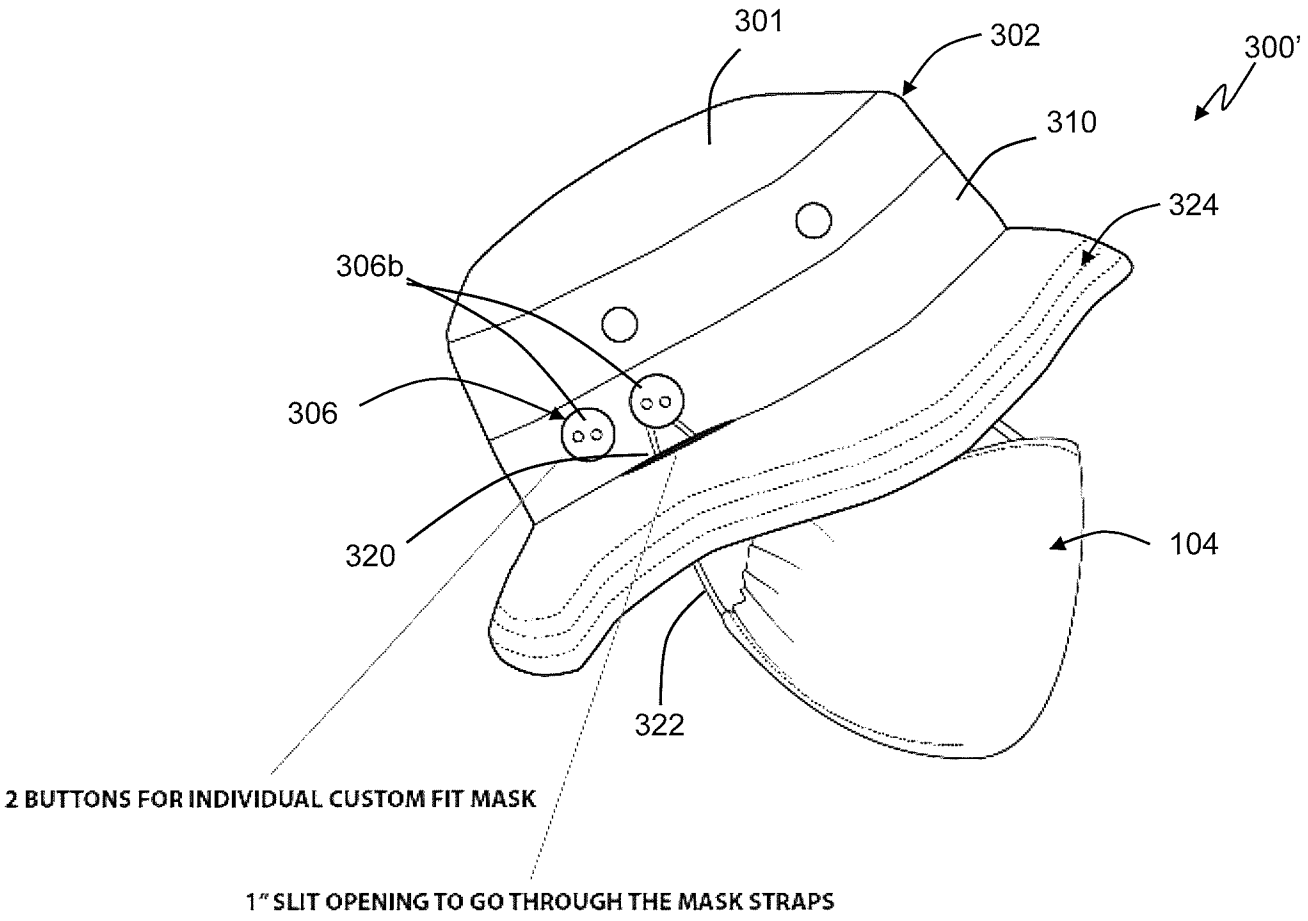
FIG. 5B illustrates a side view of an alternative aspect of a face protection system including a bucket hat, according to an aspect of this disclosure.

FIGS. 5A and 5B illustrate side views of a face protection system 300 including the bucket hat 302 with the face shield 104 coupled thereto, according to aspects of this disclosure. The bucket hat 302 comprises a body 301 and an attachment element 306. The body 301 includes an inner surface (not visible in figures) and an opposing outer surface 310. The inner surface defines a head cavity configured to receive a user's head within.

The body 301 further defines an opening 320 that extends through the body 301 from the inner surface to the outer surface 310. The opening 320 is configured to receive straps 322 of the face shield 104 therethrough so that the straps 322 can be connected to the attachment element 306. The opening 320 can be positioned near the attachment element 306. For example, the opening 320 can be positioned directly below the attachment element 306 in a vertical direction. In an aspect, the opening 320 is positioned between a brim 324 of the hat 302 and the body 301 of the hat. In alternative aspects, the opening 320 can be positioned at other locations on the body 301 adjacent to the attachment element 306. The opening 320 can provide a rigidity to the straps 322 of the face shield 104, further securing the face shield 104 to the user. The straps 322 positioned within the opening 320 can also prevent tangling the straps 322 and unintentionally catching the straps 322 onto something causing the face shield 104 to move or adjust adversely.

The attachment element 306 can include a first attachment element (not visible in figure) and a second attachment element 306*b*. Each, or either, of the first and second attachment elements 306 can include multiple attachment elements. For example, as illustrated in FIG. 5B, the second attachment element 306*b* includes two attachment elements. In an aspect, the second attachment element 306*b* includes more than one button connected to the body 301 of the hat 302. The strap 322 of the face shield 104 can extend through the opening 320 and connect to either button, and can transition between buttons to adjust the fit of the shield 104 to the user. It will be appreciated that the second attachment element 306*b* can include more than two buttons. In an aspect, the attachment element 306 can further include a grommet. The grommet can provide additional strength to the button or other attachment element connected to the body 301.

It will be appreciated that the aspects described in relation to the bucket hat 302 could be included in other head coverings configured to be positioned on a user's head. For example, the other head coverings described herein can also include openings configured and positioned substantially similarly to the opening 320 defined by the body 301.

Figure 6A:
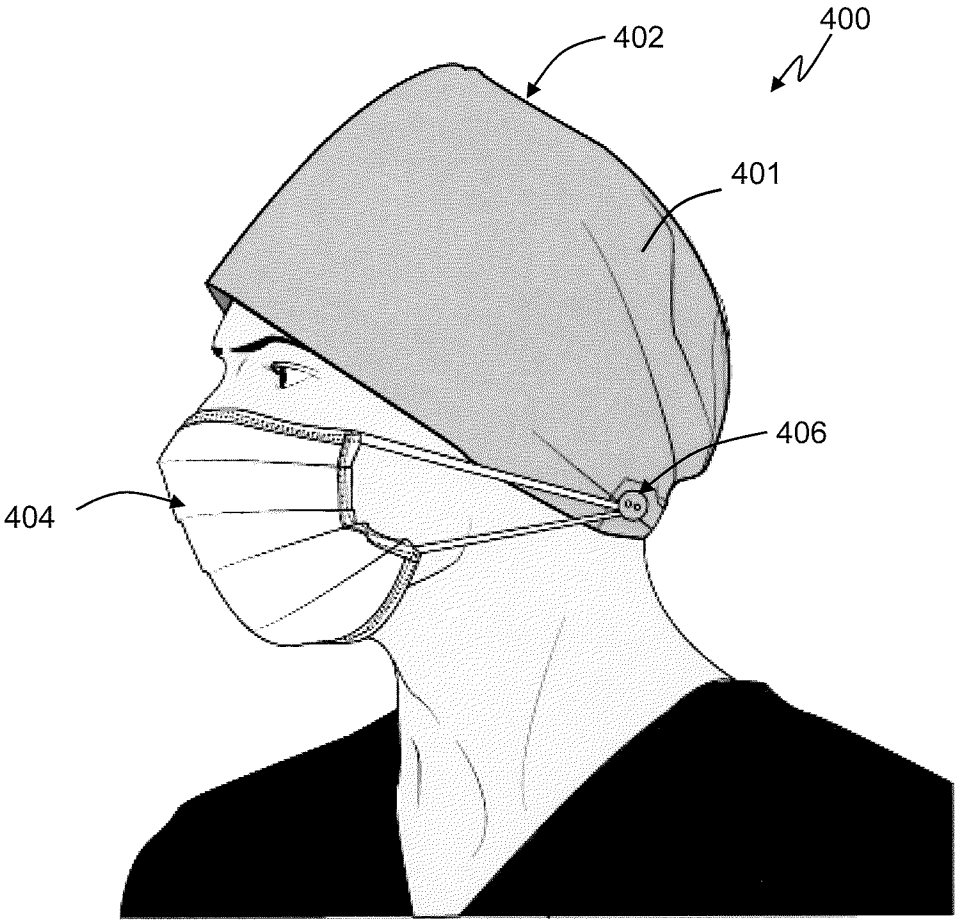
FIG. 6A illustrates a side view of a face protection system including a medical cap, according to an aspect of this disclosure.
Figure 6D:
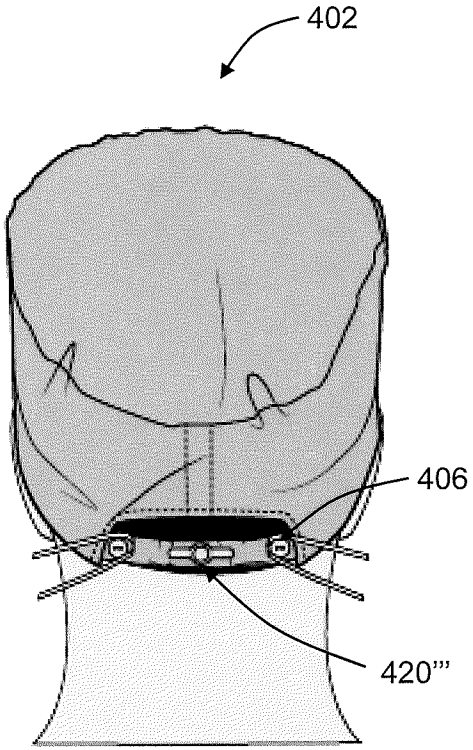
FIG. 6D illustrates a back view of an alternative aspect of a face protection system including a medical cap, according to an aspect of this disclosure.
Figure 6C:
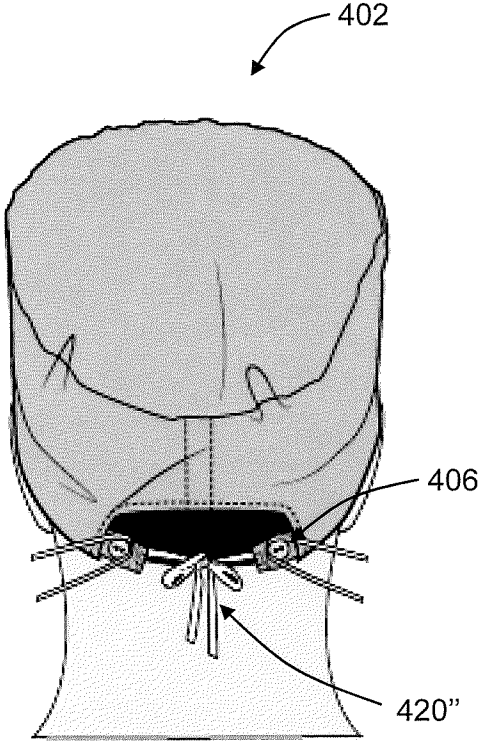
FIG. 6C illustrates a back view of an alternative aspect of a face protection system including a medical cap, according to an aspect of this disclosure.
Figure 6B:
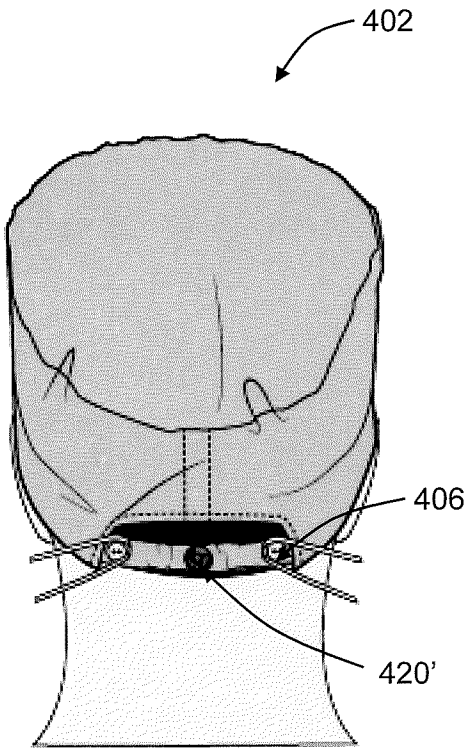
FIG. 6B illustrates a back view of the face protection system shown in FIG. 6A, according to an aspect of this disclosure.

FIG. 6A illustrates a side view of a face protection system 400 including the medical cap 402 with a face shield 404 coupled thereto, according to an aspect of this disclosure. FIGS. 6B-6D illustrate rear views of the medical cap 402 with alternative aspects for mask adjusters 420. For example, FIG. 6A illustrates a dial member 420', FIG. 6B, illustrates adjustable strings 420", and FIG. 6C illustrates a wing nut member 420'". The wing nut member 420'" can be configured to rotate to transition the attachment elements 406 between respective first and second positions. The medical hat 402 comprises a body 401 and an attachment element 406. The attachment element 406 can be positioned and configured to transition between first and second positions in a substantially similar manner as the attachment elements described above.

Figure 7:
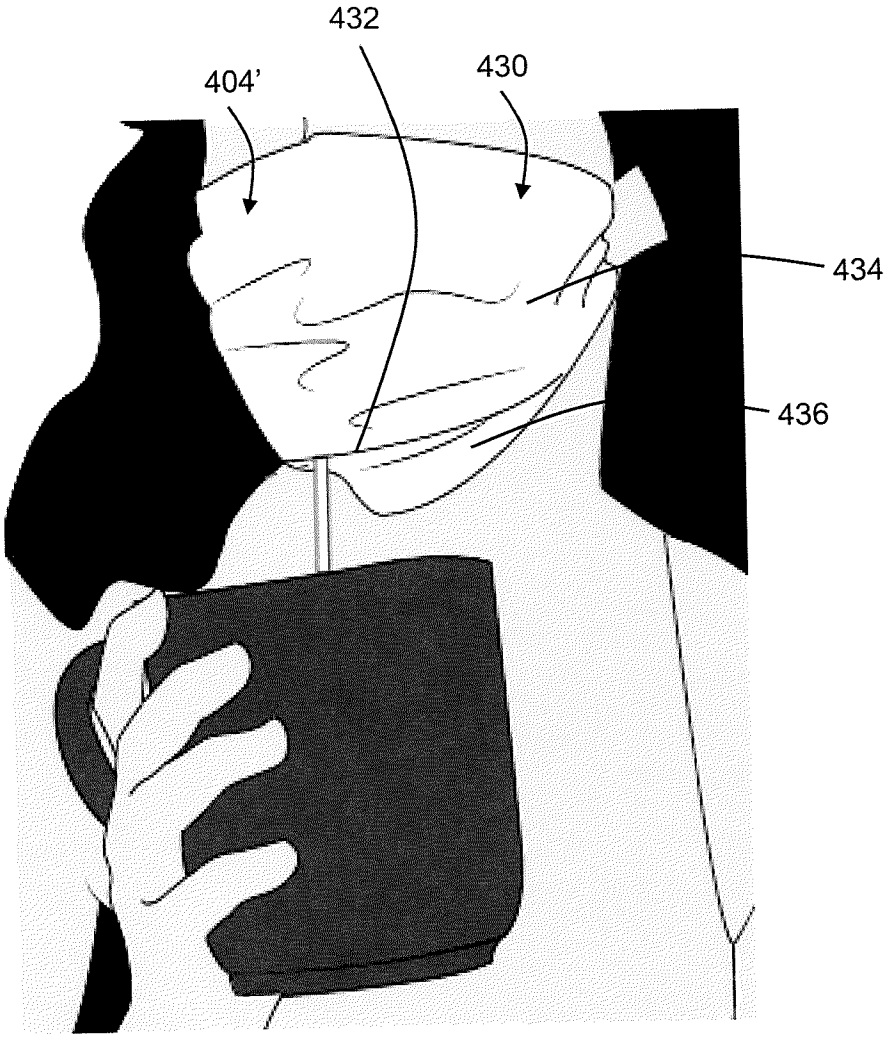
FIG. 7 illustrate a perspective view of a face shield, according to an aspect of this disclosure.

FIG. 7 illustrates a perspective of an alternative aspect of a face shield 404'. The face shield 404' includes multiple layers 430. The multiple layers 430 include a first at least one layer 434 positioned on top of a second at least one layer 436. An opening 432 is formed between the first and second at least one layers 434 and 436 that allows, for example, a straw to fit through, thereby enabling a user to drink while still protecting their face with the face shield 404'. It will be appreciated that a size of the opening 432 can range from a smaller opening to receive a straw to a larger opening to receive other items, such as, medicine, food, or still other items.

FIGS. 10-18 illustrate alternate aspects for a mask adjuster 720 (e.g. the first adjuster). It will be appreciated that the mask adjuster 720 can be configured to not only adjust the position of the attachment elements (106, 306, 406), but also to adjust a head opening of a respective hat between the first and second sizes. For example, when the mask adjuster 720 transitions the attachment elements (106, 306, 406) between their respective first and second positions, the adjuster can simultaneously transition the head opening between the first size and the second size.

Figure 10:
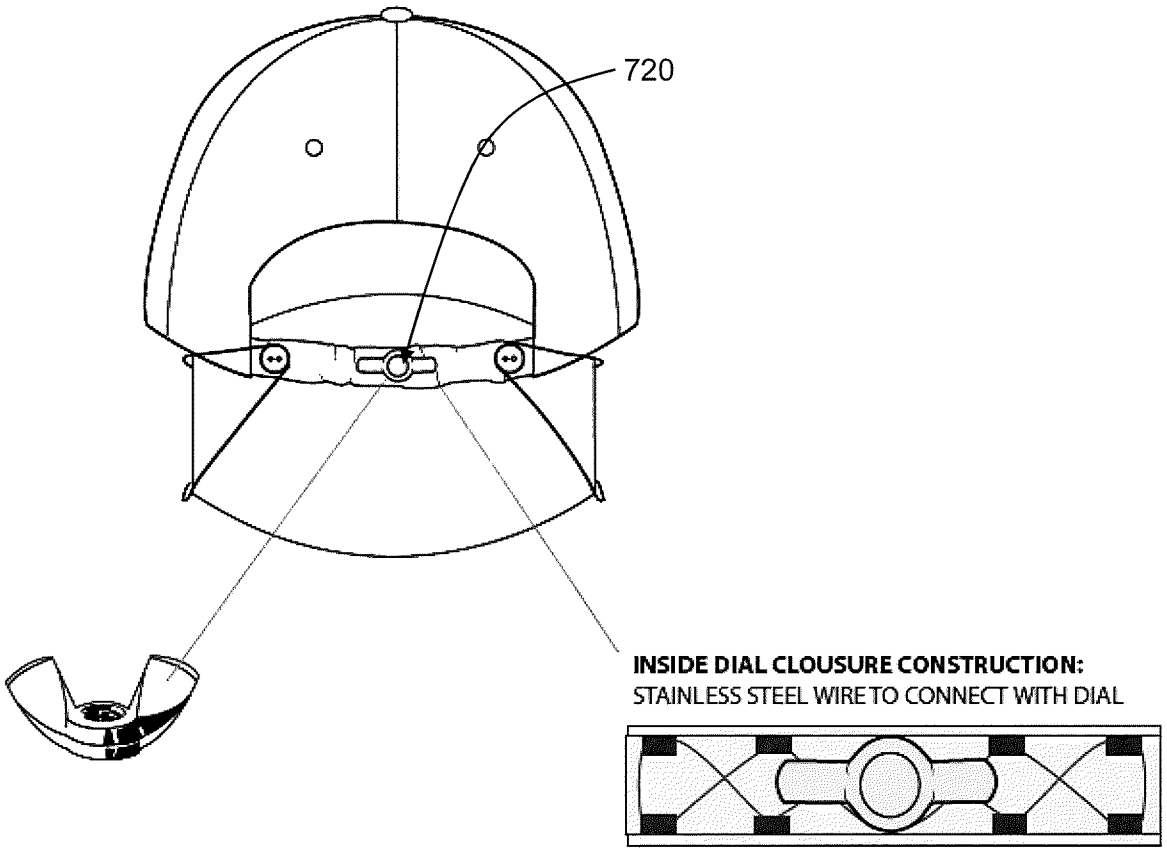
FIG. 10 illustrates a back view of a face protection system having a mask adjuster, according to an aspect of this disclosure.
Figure 11:
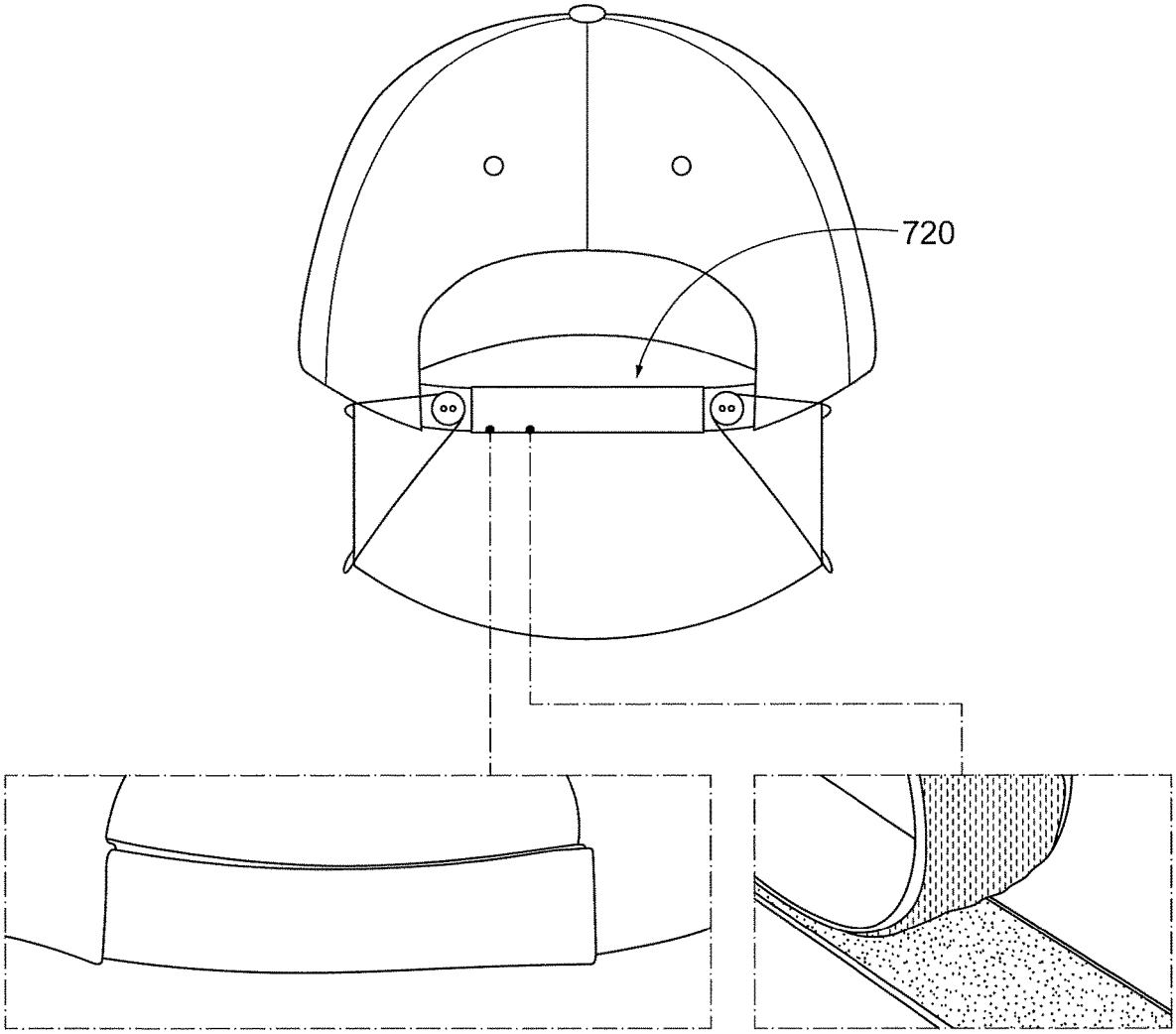
FIG. 11 illustrates a back view of a face protection system having an alternative mask adjuster, according to an aspect of this disclosure.
Figure 12:
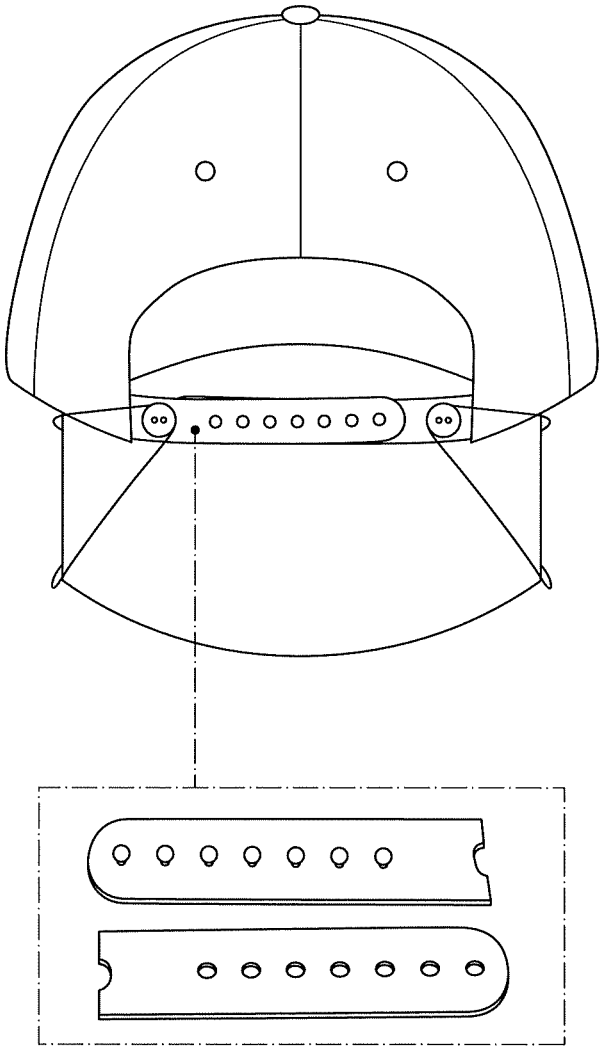
FIG. 12 illustrates a back view of a face protection system having another alternative mask adjuster, according to an aspect of this disclosure.
Figure 13:
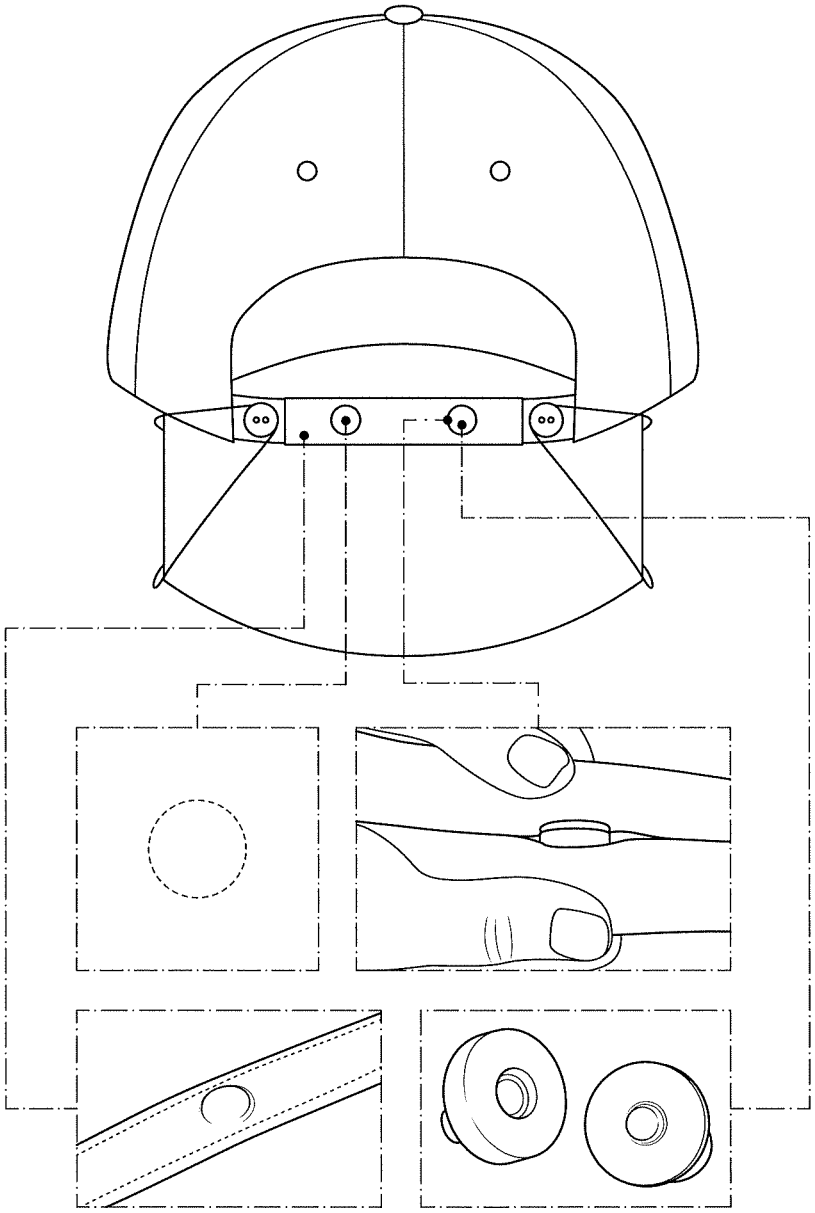
FIG. 13 illustrates a back view of a face protection system having another alternative mask adjuster, according to an aspect of this disclosure.
Figure 14:
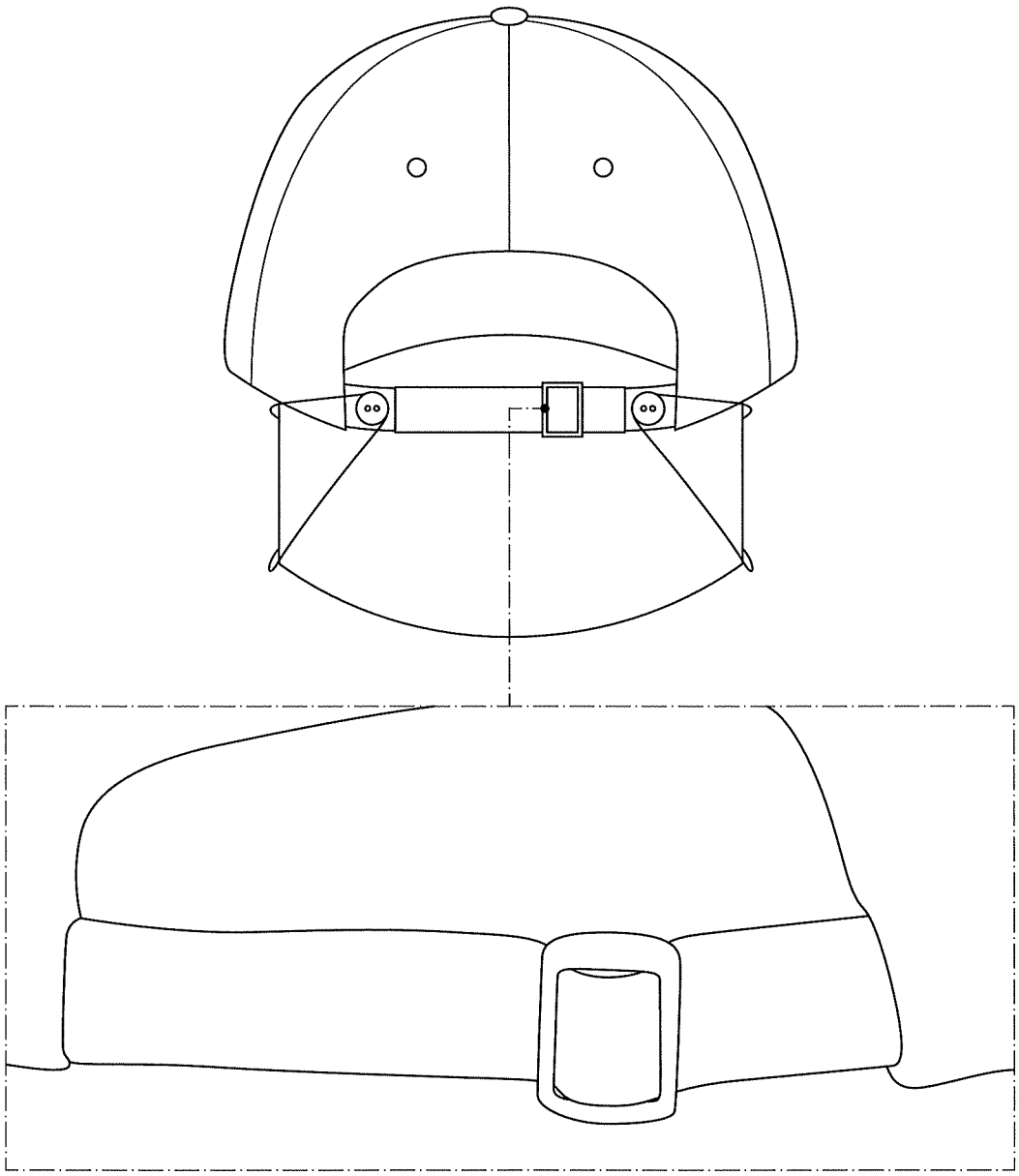
FIG. 14 illustrates a back view of a face protection system having another alternative mask adjuster, according to an aspect of this disclosure.
Figure 15:
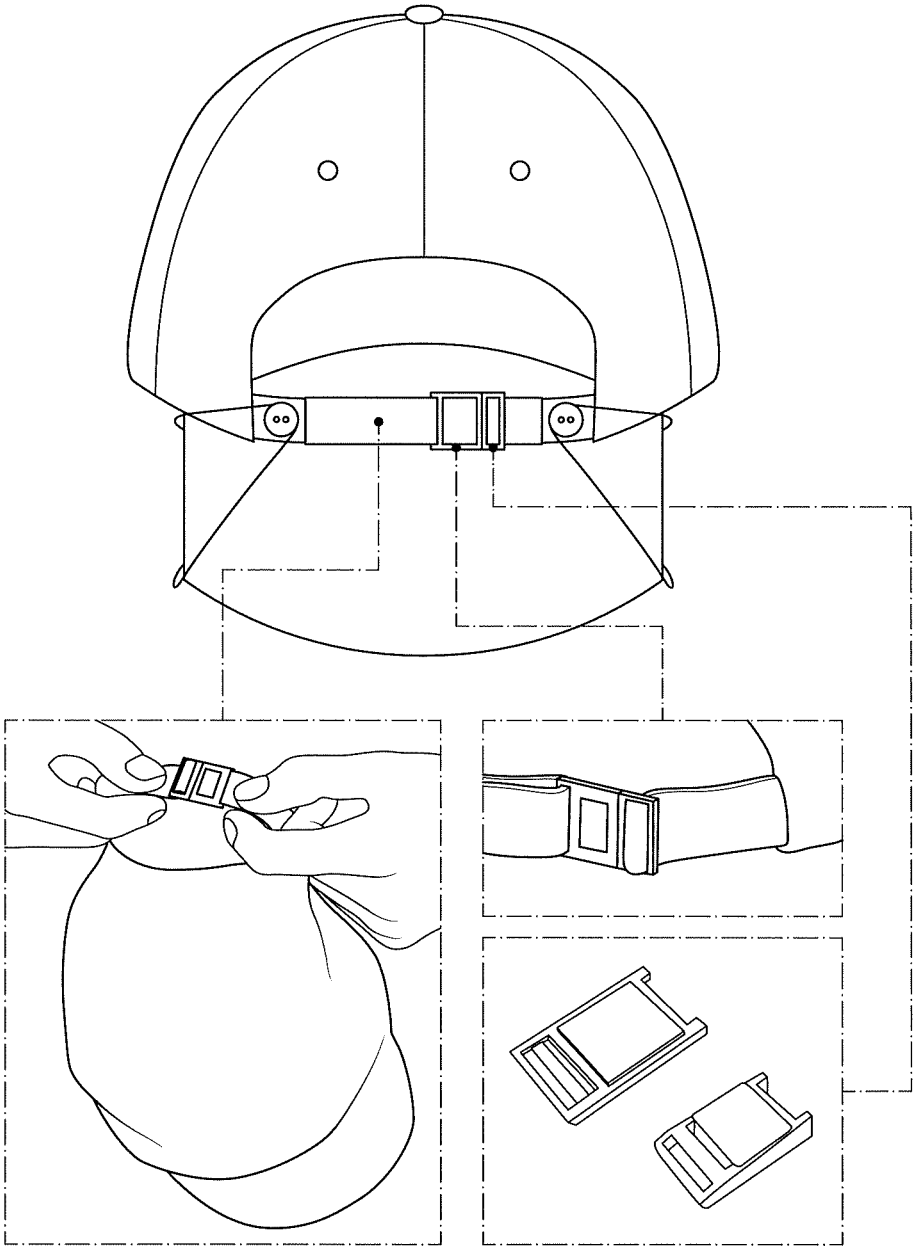
FIG. 15 illustrates a back view of a face protection system having another alternative mask adjuster, according to an aspect of this disclosure.
Figure 16:
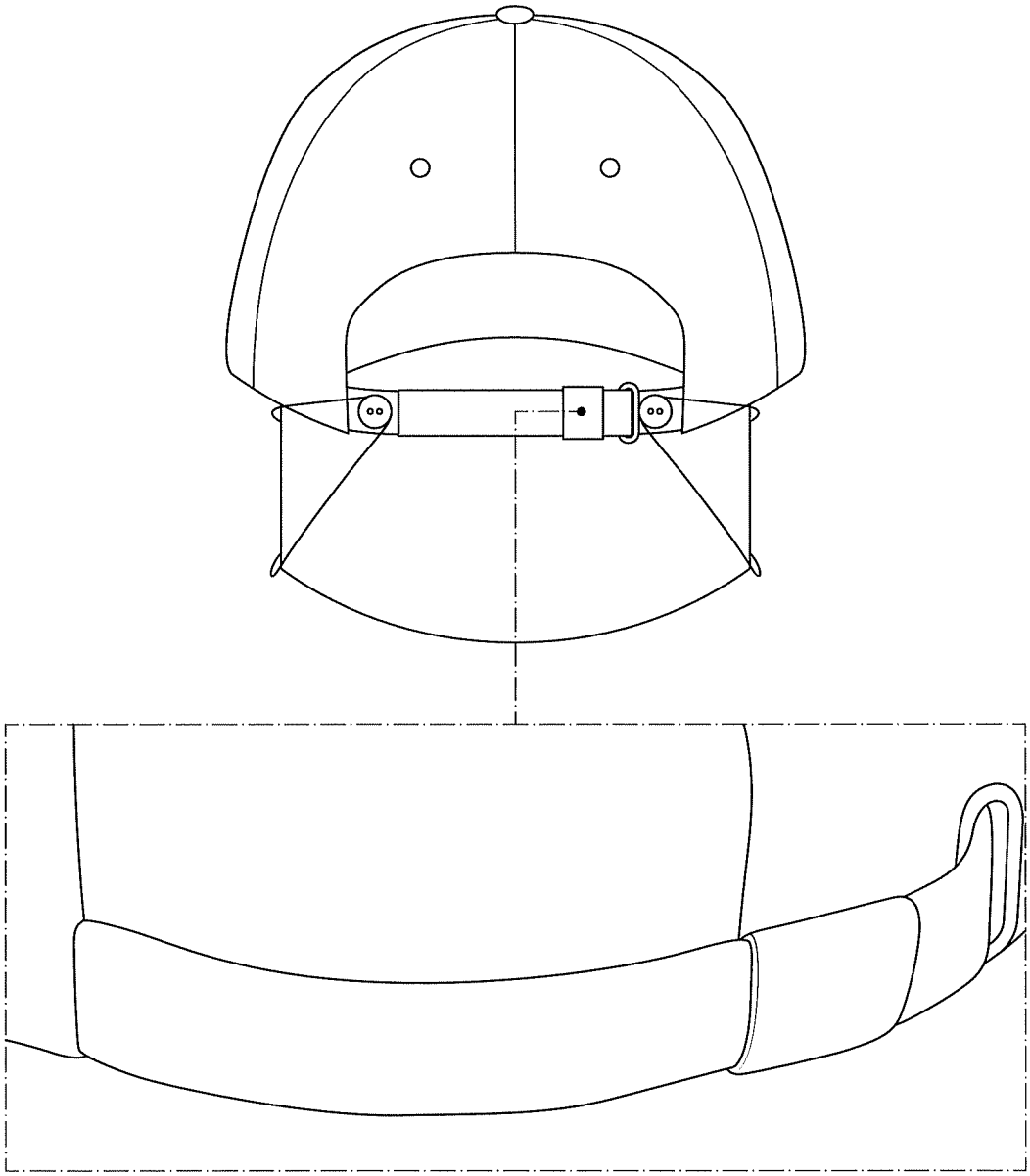
FIG. 16 illustrates a back view of a face protection system having another alternative mask adjuster, according to an aspect of this disclosure.
Figure 17:
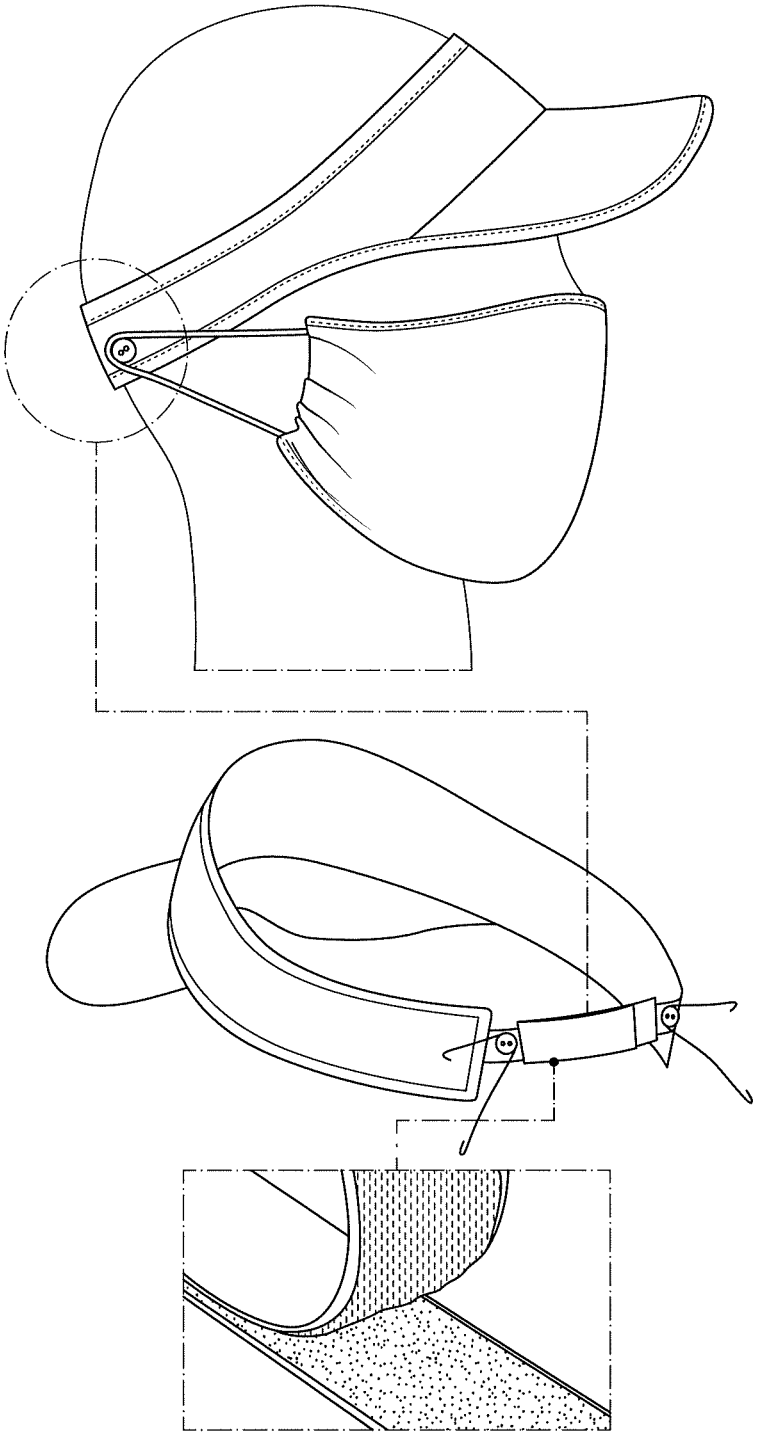
FIG. 17 illustrates a side view of a face protection system having another alternative mask adjuster, according to an aspect of this disclosure.
Figure 18:
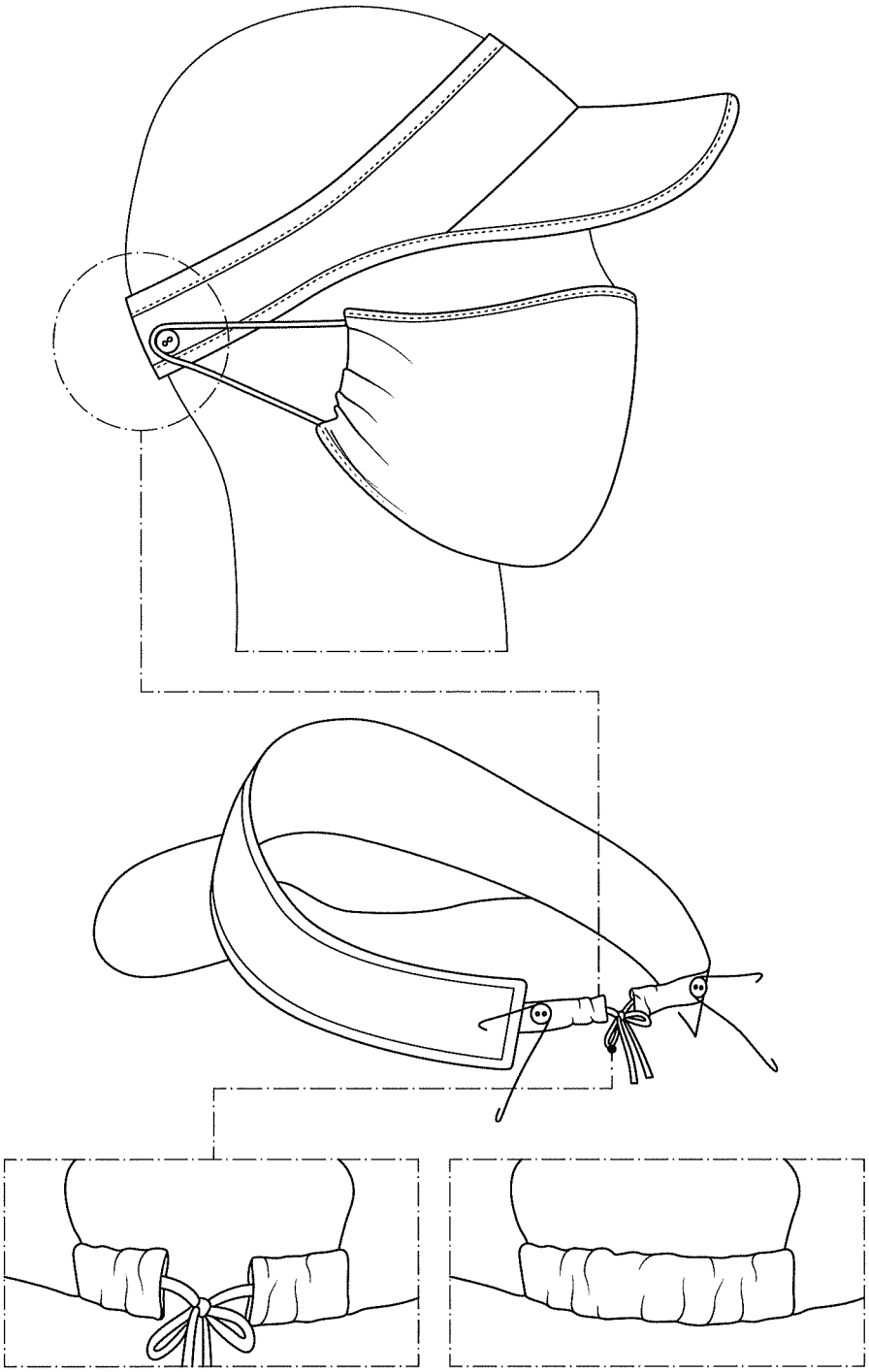
FIG. 18 illustrates a side view of a face protection system having another alternative mask adjuster, according to an aspect of this disclosure.

FIG. 10 illustrates the mask adjuster 720 comprising a wing nut member. FIG. 11 illustrates the mask adjuster 720 comprising an adjustable Velcro closure. FIG. 12 illustrates the mask adjuster 720 comprising an adjustable plastic snap. FIG. 13 illustrates the mask adjuster 720 comprising a magnetic strap including at least one set of corresponding magnets. FIG. 14 illustrates the mask adjuster 720 comprising a slider closure. FIG. 15 illustrates the mask adjuster 720 comprising a plastic buckle closure. FIG. 16 illustrates the mask adjuster 720 comprising a metal buckle and tuck in closure. FIG. 17 illustrates the mask adjuster 720 comprising a back Velcro closure on a visor hat. FIG. 18 illustrates the mask adjuster 720 comprising a back elastic and tie closure.

Figure 19:
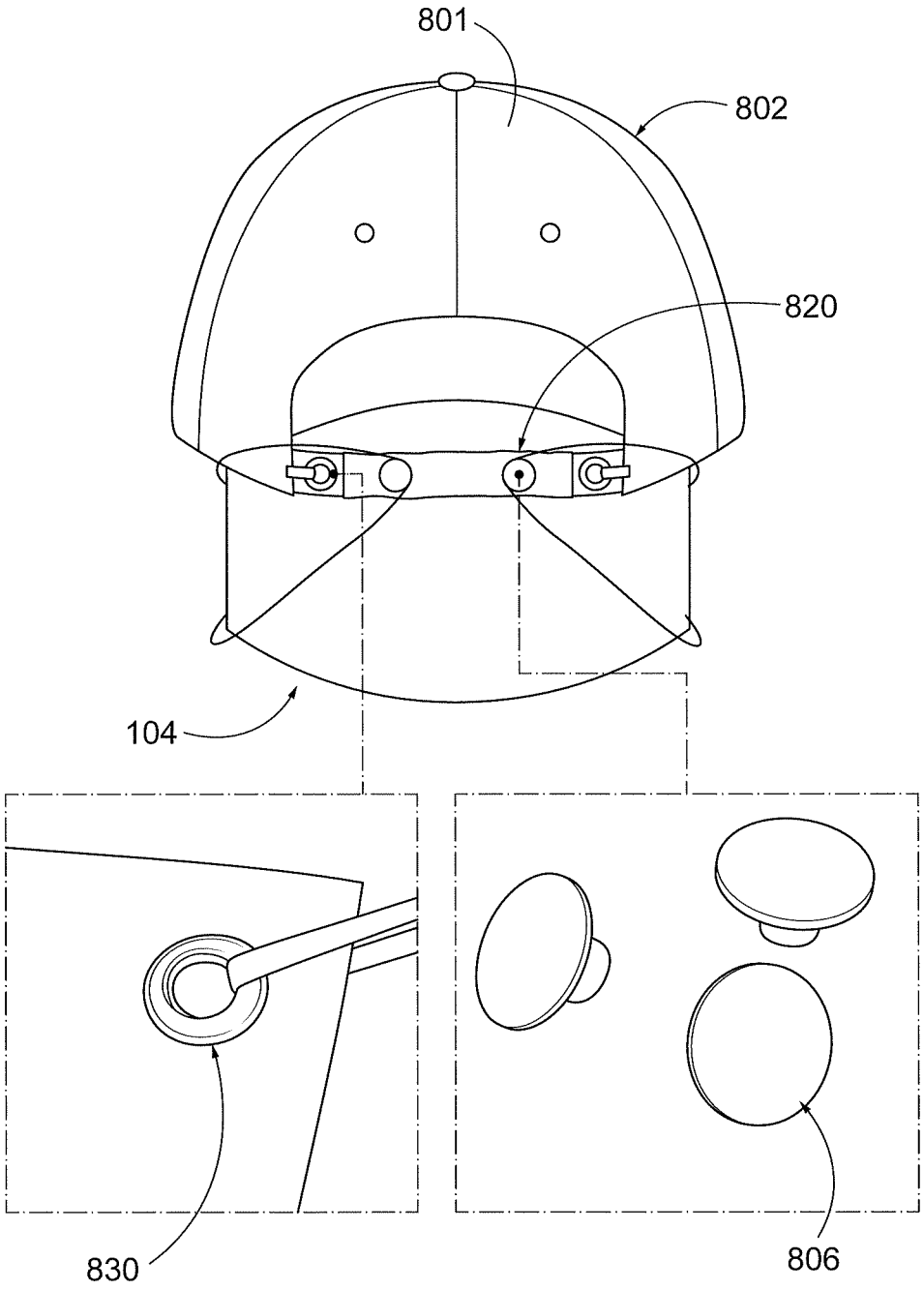
FIG. 19 illustrates a back view of a face protection system having another alternative mask adjuster, according to an aspect of this disclosure.

FIG. 19 illustrates another alternative aspect for a mask adjuster 820 configured to couple to a cap 802. The mask adjuster 820 can include a grommet 830 and a retention element 806. The grommet 830 can include one or more grommets, and the retention element 806 can include one or more elements. The grommet 830 and the retention element 806 can provide an additional reinforcement strength between a body 801 of the cap 802 and the mask adjuster 820. In an aspect, the grommet 830 comprises a metal. Additionally or alternatively, the retention element 806 comprises a metal. The grommet 830 can include a ring for receiving a closure member 850 within. As illustrated in FIG. 19, the closure member 850 can include an adjustable snap closure. The retention element 806 can comprise one or more buttons that can be removed and/or transitioned between positions on the adjuster 820 or body 801 of the cap 802 to adjust the fitting of the face shield 104.

Figure 20:
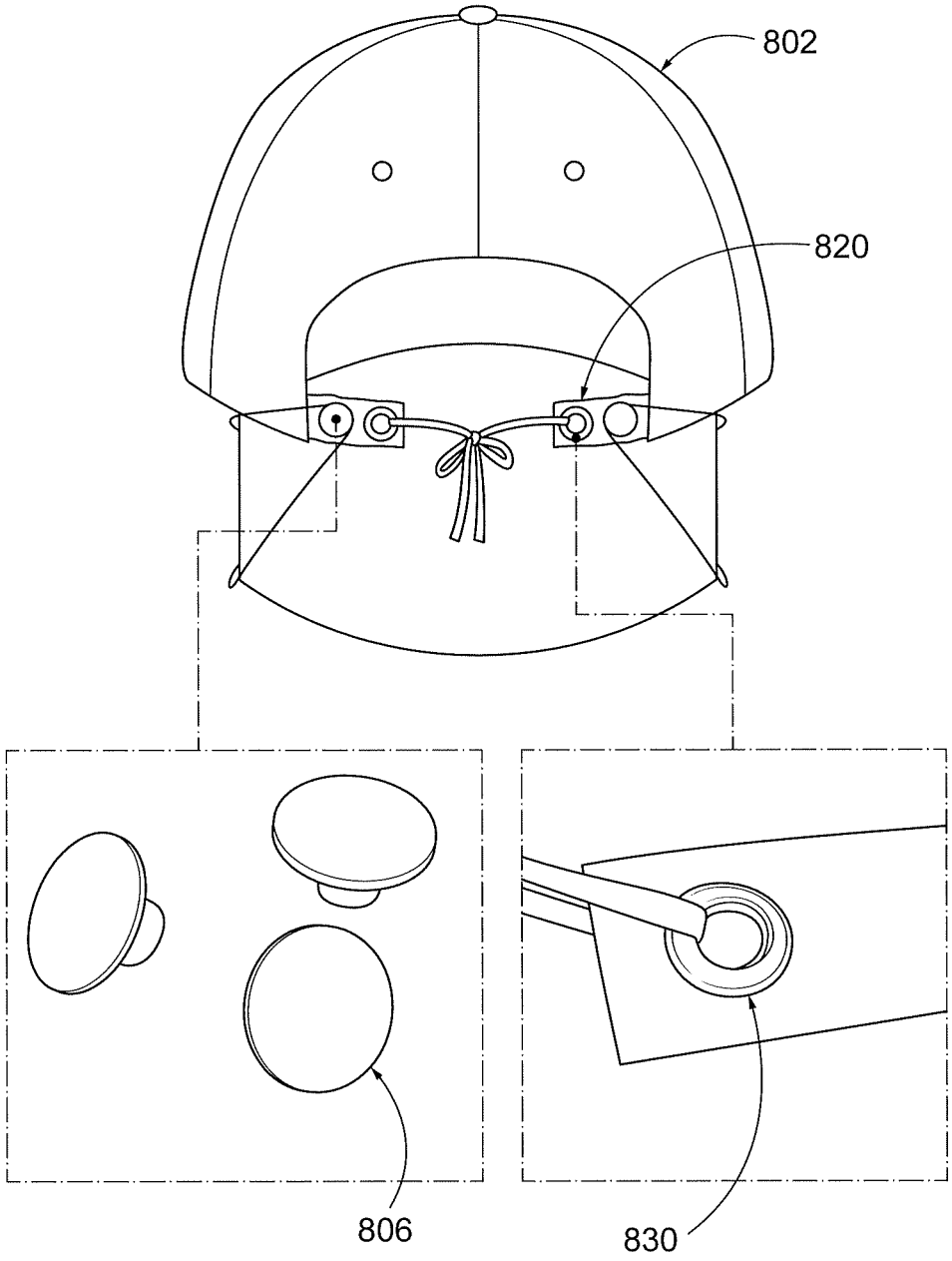
FIG. 20 illustrates a back view of a face protection system having another alternative mask adjuster, according to an aspect of this disclosure.
Figure 21:
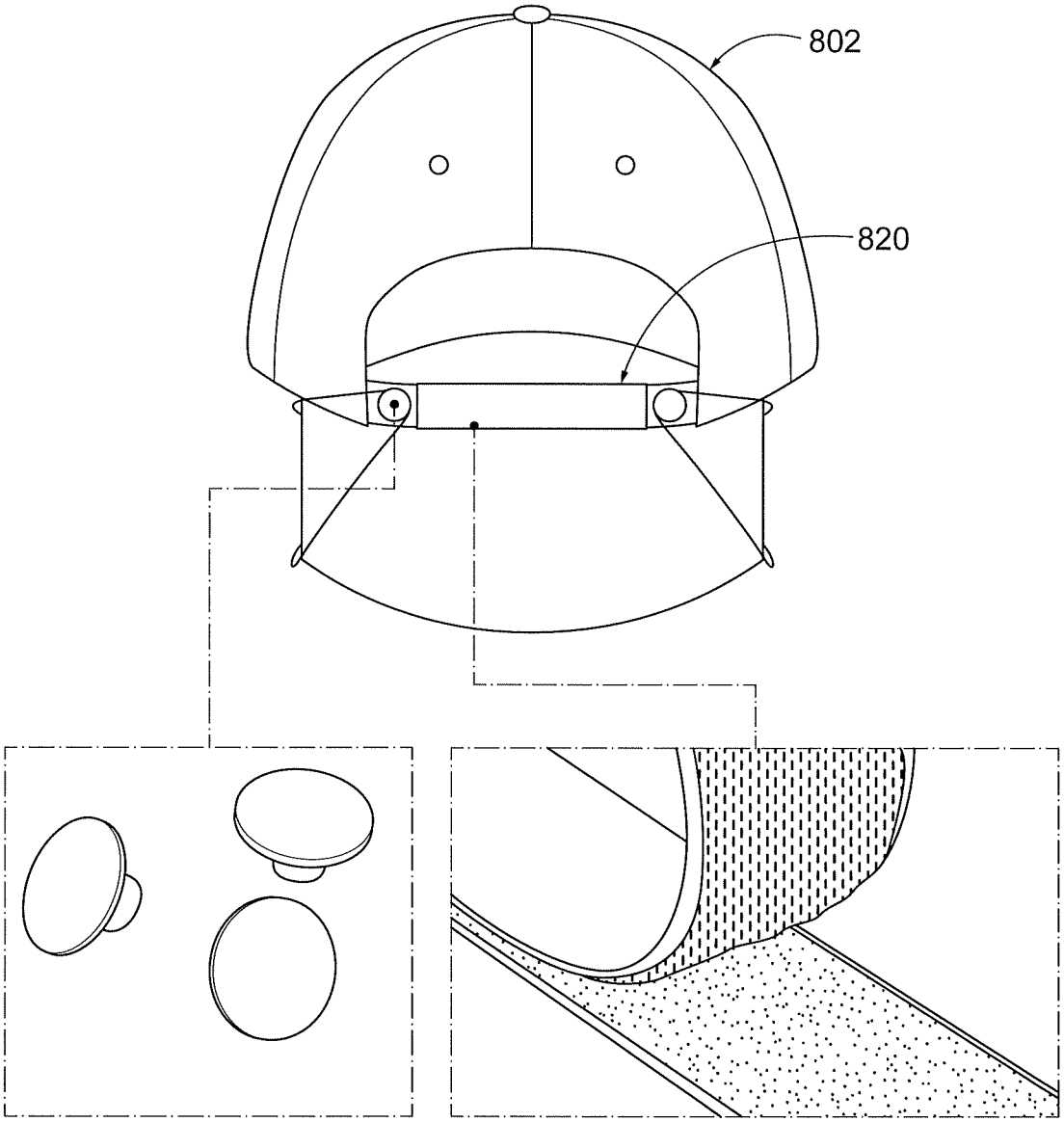
FIG. 21 illustrates a back view of a face protection system having another alternative mask adjuster, according to an aspect of this disclosure.

FIG. 20 illustrates another alternative aspect for the mask adjuster 820 configured to couple to the cap 802. In this aspect, the adjuster 820 comprises adjustable strings. FIG. 21 illustrates another alternative aspect for the mask adjuster 820. In this aspect, the adjuster 820 comprises an adjustable Velcro closure.

It will be appreciated that the mask adjusters (120, 320, 420, 720, 820) can also be applied to goggles. For example, the straps of goggles can be attached to attachment elements on a head covering. The attachment elements can be transitioned between first and second positions to adjust the goggles to the user's face.

Additionally, any of the embodiments disclosed herein can incorporate features disclosed with respect to any of the other embodiments disclosed herein. Moreover, the scope of the present disclosure is not intended to be limited to the particular embodiments described in the specification. As one of ordinary skill in the art will readily appreciate from that processes, machines, manufacture, composition of matter, means, methods, or steps, presently existing or later to be developed that perform substantially the same function or achieve substantially the same result as the corresponding embodiments described herein may be utilized according to the present disclosure.

What is claimed:

1. A head covering comprising:

a body defining a head opening configured to receive a user's head therethrough;

an attachment element coupled to the body, the attachment element being configured to couple to a face shield positionable on the user's face via a strap; and an adjuster coupled to the attachment element, the adjuster configured to transition the attachment element between a first position and a second position, wherein when the attachment element transitions from the first position to the second position a tension in the strap transitions from a first tension to a second tension that is greater than the first tension, wherein the attachment element is separated from the adjuster by a first distance when the attachment element is in the first position, the attachment element is separated from the adjuster by a second distance when the attachment element is in the second position, and the first distance is greater than the second distance, and wherein the adjuster comprises a dial member that is manually rotatable between a first dial position and a second dial position rotatably spaced from the first dial position, wherein when the dial member is in the first dial position the attachment element is in the first position, and wherein when the dial member is rotated to the second dial position the attachment element transitions to the second position.

2. The head covering of claim 1, wherein the body comprises a mask compartment, wherein the body and mask compartment define a compartment opening and a compartment cavity, the compartment opening being sized for receiving the face shield therethrough, and the compartment cavity being sized to store the face shield within.

3. The head covering of claim 2, wherein the body includes an inner body surface, the inner body surface defining a head cavity for receiving the user's head within, wherein the mask compartment is positioned within the head cavity.

4. The head covering of claim 1, wherein the body comprises at least one of a baseball cap, a skull cap, a visor, and a bucket hat.

5. The head covering of claim 1, wherein the attachment element is a first attachment element and the head covering further comprises a second attachment element, wherein the adjuster is configured to transition each of the first and second attachment elements between respective first and second positions, and wherein the second attachment element is separated from the adjuster by an initial distance when the second attachment element is in its first position, the second attachment element is separated from the adjuster by an adjusted distance when the second attachment element is in its second position, and the initial distance is greater than the adjusted distance.

6. The head covering of claim 5, wherein the first and second attachment elements are spaced from each other by a third distance when the first and second attachment elements are in their respective first positions, the first and second attachment elements are spaced from each other by a fourth distance when the first and second attachment elements are in their respective second positions, and the fourth distance is less than the third distance.

7. A head covering comprising:

a body defining a head opening configured to receive a user's head therethrough;

a first attachment element and a second attachment element coupled to the body, the first and second attachment elements being configured to couple to a face shield positionable on the user's face via a strap, wherein the first and second attachment elements are separated from each other by a first distance in a first configuration, the first and second attachment elements are separated from each other by a second distance in a second configuration, and the first distance is greater than the second distance; and an adjuster coupled to the first and second attachment elements, the adjuster configured to transition the first and second attachment elements between the first configuration and the second configuration, wherein when the first and second attachment elements transition from the first configuration to the second configuration a tension in the strap transitions from a first tension to a second tension that is greater than the first tension, wherein the adjuster comprises a dial member that is manually rotatable between a first dial position and a second dial position rotatably spaced from the first dial position, wherein when the dial member is in the first dial position the attachment element is in the first position, and wherein when the dial member is rotated to the second dial position the attachment element transitions to the second position.

8. The head covering of claim 7, wherein the body comprises a mask compartment, wherein the body and mask compartment define a compartment opening and a compartment cavity, the compartment opening being sized for receiving the face shield therethrough, and the compartment cavity being sized to store the face shield within.

9. The head covering of claim 8, wherein the body includes an inner body surface, the inner body surface defining a head cavity for receiving the user's head within, wherein the mask compartment is positioned within the head cavity.

10. The head covering of claim 7, wherein the body comprises at least one of a baseball cap, a skull cap, a visor, and a bucket hat.

* * * * *